US008807735B2

(12) United States Patent
Houjou

(10) Patent No.: US 8,807,735 B2
(45) Date of Patent: Aug. 19, 2014

(54) INKJET RECORDING APPARATUS AND INKJET RECORDING METHOD

(71) Applicant: FUJIFILM Corporation, Tokyo (JP)

(72) Inventor: Hiroaki Houjou, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 13/726,331

(22) Filed: Dec. 24, 2012

(65) Prior Publication Data

US 2013/0222479 A1 Aug. 29, 2013

(30) Foreign Application Priority Data

Feb. 29, 2012 (JP) ..... 2012-044118

(51) Int. Cl.
*B41J 2/01* (2006.01)

(52) U.S. Cl.
USPC ..... 347/102

(58) Field of Classification Search
USPC ..... 347/102, 40, 43, 95–96, 100
See application file for complete search history.

(56) References Cited

U.S. PATENT DOCUMENTS

| | | | | |
|---|---|---|---|---|
| 6,299,287 | B1 * | 10/2001 | Williams et al. | 347/43 |
| 8,177,349 | B2 * | 5/2012 | Fukui | 347/102 |
| 8,425,030 | B2 * | 4/2013 | Irita | 347/100 |
| 2011/0211012 | A1 | 9/2011 | Irita | |

FOREIGN PATENT DOCUMENTS

| | | | |
|---|---|---|---|
| JP | 2003-153888 | A | 5/2003 |
| JP | 2004-090303 | A | 3/2004 |
| JP | 2004-106543 | A | 4/2004 |
| JP | 2005-153507 | A | 6/2005 |
| JP | 2007-118409 | A | 5/2007 |
| JP | 2009-190394 | A | 8/2009 |
| JP | 2011-178029 | A | 9/2011 |
| JP | 2011-178142 | A | 9/2011 |

OTHER PUBLICATIONS

An Office Action; "Notice of Reasons for Rejection," issued by the Japanese Patent Office on Feb. 4, 2014, which corresponds to Japanese Patent Application No. 2012-044118 and is related to U.S. Appl. No. 13/726,331; with English language translation.

* cited by examiner

*Primary Examiner* — Lamson Nguyen
(74) *Attorney, Agent, or Firm* — Studebaker & Brackett PC

(57) ABSTRACT

There is provided an inkjet recording apparatus including: plural jetting heads that jet respectively different types of photocurable color inks onto a conveyed recording medium and which, when layer-jetting the different types of photocurable color inks onto the recording medium, first jet the photocurable color ink having the largest light blocking effect among the plural photocurable color inks that the plural jetting heads layer-jet; and an irradiation device that applies light to the photocurable color inks that have been jetted onto the recording medium.

8 Claims, 8 Drawing Sheets

INKJET RECORDING APPARATUS AND INKJET RECORDING METHOD

CROSS-REFERENCE TO RELATED APPLICATION

This application is based on and claims priority under 35 USC 119 from Japanese Patent Application No. 2012-044118 filed on Feb. 29, 2012, the disclosure of which is incorporated by reference herein.

BACKGROUND

1. Technical Field

The present invention relates to an inkjet recording apparatus and an inkjet recording method.

2. Related Art

Inkjet recording apparatus equipped with plural jetting heads that jet respectively different types of photocurable color inks onto conveyed paper sheets and an irradiation device that applies light to the photocurable color inks that have been jetted onto the paper sheets are known as image forming apparatus.

Here, Japanese Patent Application Laid-Open (JP-A) No. 2011-178142 discloses an inkjet recording apparatus which, when layer-jetting photocurable color inks onto paper sheets, jets the photocurable color inks in order beginning with the photocurable color ink whose photocurability is high for the purpose of countering bleeding.

Further, JP-A No. 2009-190394 and JP-A No. 2003-153888 disclose inkjet recording apparatus which, when layer-jetting color inks that are not photocurable onto paper sheets, jets the color inks in order beginning with the color ink whose concentration is large in order to control deterioration of granularity.

However, in JP-A No. 2011-178142, the irradiation device applies the light every time the photocurable color inks are jetted, but supposing a case where, considering energy efficiency, the irradiation device applies the light across the board after the inkjet recording apparatus has layer-jetted the photocurable color inks in order beginning with the photocurable color ink whose photocurability is high, the light would strike the layered ink (image membrane) in which the photocurable color inks are layered in descending order of photocurability in the thickness direction of the paper sheets. Here, descending order of photocurability is not always descending order of light blocking effect, so sometimes the ink layer having the large light blocking effect is positioned on the top layer side of the layered ink. When the ink layer having the large light blocking effect is positioned on the top layer side of the layered ink, the light becomes blocked at the top layer side of the layered ink and the amount of light passing through to the middle of the layered ink ends up decreasing. As a result, curing does not proceed to the middle of the layered ink, and the film strength of the layered ink ends up becoming lower.

Further, in JP-A No. 2009-190394 and JP-A No. 2003-153888, the inkjet recording apparatus layer jets color inks that are not photocurable, so depending on the passage of the light, the problem of the film strength of the layered ink becoming lower does not occur.

SUMMARY

The present invention has been made in view of the circumstances described above, and it is an object thereof to provide an inkjet recording apparatus and an inkjet recording method that can raise the film strength of layered ink when layer-jetting photocurable color inks onto a recording medium.

A first aspect of the present invention provides an inkjet recording apparatus including:

plural jetting heads that jet respectively different types of photocurable color inks onto a conveyed recording medium and which, when layer-jetting the different types of photocurable color inks onto the recording medium, first jet the photocurable color ink having the largest light blocking effect among the plural photocurable color inks that the plural jetting heads layer-jet; and an irradiation device that applies light to the photocurable color inks that have been jetted onto the recording medium.

According to this configuration, when the plural jetting heads layer-jet the different types of photocurable color inks onto the recording medium, the plural jetting heads first jet the photocurable color ink having the largest effect of blocking the light applied by the irradiation device among the plural photocurable color inks that the plural jetting heads layer-jet, so the ink layer having the largest light blocking effect becomes positioned in the deepest layer of the layered ink in which the plural types of photocurable color inks are layered in the thickness direction of the recording medium. Additionally, when the light applied from the irradiation device strikes the layered ink, the light passes through from the top layer side to the deep layer side of the layered ink and finally passes through the ink layer having the largest light blocking effect that is positioned in the deepest layer. Because of this, the light does not pass through the ink layer having the largest light blocking effect until the light passes through to the deepest layer of the layered ink, so the light can be kept from being blocked at the top layer side of the layered ink, and the amount of light passing through to particularly the deepest layer on the deep layer side of the layered ink can be increased. As a result, photocuring proceeds to the ink layers on the deep layer side of the layered ink, and the film strength of the layered ink becomes higher.

A second aspect of the present invention provides the inkjet recording apparatus according to the first aspect, wherein the different types of photocurable color inks each include a common photopolymerization initiator and different types of pigments, and when the plural jetting heads layer-jet the photocurable color inks, the plural jetting heads first jet the photocurable color ink whose pigment has the largest light absorption intensity in the light wavelength range in which the light absorption intensity of the photopolymerization initiator reaches a peak.

Here, the photopolymerization initiator common to the plural photocurable color inks generates radicals upon exposure to light energy. The radicals react with the reactive group of the monomer or oligomer in the photocurable color inks, initiate polymerization, and cause the curing of the photocurable color inks to proceed. For this reason, if the light absorption intensity of the pigment is large in the wavelength range in which the light absorption intensity of the photopolymerization initiator reaches a peak, the light ends up being blocked by the pigment, the radical generation rate of the photopolymerization initiator drops, and curability drops.

Therefore, according to the configuration of the second aspect, when the plural jetting heads layer-jet the different types of photocurable color inks onto the recording medium, the plural jetting heads first jet the photocurable color ink whose pigment has the largest light absorption intensity in the above-described wavelength range. Because of this, the ink layer whose pigment has the largest light absorption intensity in the above-described wavelength range becomes positioned in the deepest layer of the layered ink.

Additionally, when the light applied from the irradiation device strikes the layered ink, the light does not pass through the layer of the photocurable color ink whose pigment has the largest light blocking effect in the above-described wavelength range until the light passes through to the deepest layer, so light in the wavelength range needed for radical generation by the photopolymerization initiator can be kept from being blocked at the top layer side of the layered ink, and the amount of light passing through to particularly the deepest layer on the deep layer side of the layered ink can be increased. As a result, photocuring proceeds to the ink layers on the deep layer side of the layered ink, and the film strength of the layered ink becomes higher.

A third aspect of the present invention provides the inkjet recording apparatus according to the first aspect, wherein when the plural jetting heads layer-jet the photocurable color inks, the plural jetting heads jet the photocurable color inks in descending order of light blocking effect.

According to this configuration, the ink layers become positioned in descending order of light blocking effect from the deepest layer to the topmost layer of the layered ink in which the plural types of photocurable color inks are layered in the thickness direction of the recording medium.

Additionally, when the light applied from the irradiation device strikes the layered ink, the light passes through from the top layer side to the deep layer side of the layered ink—that is, the light passes through in order beginning with the ink layer having the small light blocking effect. Because of this, the light can be kept from being blocked at the top layer side of the layered ink, and the amount of light passing through to the deep layer side of the layered ink can be increased. As a result, photocuring proceeds to the ink layers on the deep layer side of the layered ink, and the film strength of the layered ink becomes higher.

A fourth aspect of the present invention provides the inkjet recording apparatus according to the third aspect, wherein the plural jetting heads are placed from upstream to downstream in a conveyance direction of the recording medium in such a way as to jet the photocurable color inks in descending order of light blocking effect.

According to this configuration, the plural jetting heads jet the photocurable color inks in order from the jetting head on the upstream side in the conveyance direction of the recording medium to the jetting head on the downstream side, whereby the photocurable color inks become jetted in descending order of light blocking effect onto the recording medium. Because of this, the control of the jetting heads can be simplified.

A fifth aspect of the present invention provides the inkjet recording apparatus according to the first aspect, further including an adjustment unit that adjusts the peak illuminance value of the irradiation device or the integrated amount of irradiation in accordance with the combination of the photocurable color inks when the photocurable color inks are layer-jetted.

According to this configuration, the adjustment unit can keep the film strength of the layered ink constant even when the combination of the photocurable color inks changes by performing an adjustment that raises the peak illuminance value of the irradiation device or increases the integrated amount of irradiation in a case where, depending on the combination of the photocurable color inks, for example, the film strength of the layered ink will not become the required film strength.

A sixth aspect of the present invention provides the inkjet recording apparatus according to the fifth aspect, wherein the adjustment unit adjusts the peak illuminance value by varying the output of a light source of the irradiation device or adjusts the peak illuminance value by varying the distance between the light source of the irradiation device and the conveyed recording medium.

Examples of ways in which the adjustment unit adjusts the peak illuminance value in this way include varying the output of a light source of the irradiation device and varying the distance between the light source of the irradiation device and the conveyed recording medium.

A seventh aspect of the present invention provides the inkjet recording apparatus according to the first aspect, further including a drying section that dries the recording medium in such a way that the water content on the recording medium including water in the photocurable color inks becomes 3.0 $g/m^2$ or less before the application of light by the irradiation device.

According to this configuration, the curability of the photocurable color inks can be ensured.

An eighth aspect of the present invention provides the inkjet recording apparatus according to the first aspect, further including an aggregating agent application section which, before the photocurable color inks are jetted, applies to the recording medium an aggregating agent that causes the photocurable color inks that are to be jetted to aggregate.

According to this configuration, the aggregating agent application section applies the aggregating agent to the recording medium, so the pigments and the water in the photocurable color inks that have been jetted by the jetting heads are separated by the aggregating action of the aggregating agent. Because of this separation, the drying of the photocurable color inks can be promoted.

A ninth aspect of the present invention provides the inkjet recording apparatus according to the first aspect, wherein the jetting heads jet the photocurable color inks in such a way that the total amount of the photocurable color inks on the recording medium becomes a maximum of 15 $ml/m^2$ or less.

According to this configuration, the curability of the photocurable color inks can be ensured.

A tenth aspect of the present invention provides an inkjet recording method of layer-jetting different types of photocurable color inks onto a conveyed recording medium, the inkjet recording method including:

jetting, using jetting heads, first the photocurable color ink having the largest light blocking effect among the plural photocurable color inks that the jetting heads layer-jet and to thereafter jet the remaining photocurable color inks in such a way that the remaining photocurable color inks become layered on the photocurable color ink having the largest light blocking effect; and irradiating, using an irradiation device, light to the photocurable color inks that have been layer-jetted onto the recording medium.

According to this method, when the light applied from the irradiation device strikes the photocurable color inks that have been layer-jetted, that is, the layered ink, the light passes through from the top layer side to the deep layer side of the layered ink and finally passes through the ink layer having the largest light blocking effect that is positioned in the deepest layer. Because of this, the light does not pass through the ink layer having the largest light blocking effect until the light passes through to the deepest layer of the layered ink, so the light can be kept from being blocked at the top layer side of the layered ink, and the amount of light passing through to particularly the deepest layer on the deep layer side of the layered ink can be increased. As a result, photocuring proceeds to the ink layers on the deep layer side of the layered ink, and the film strength of the layered ink becomes higher.

An eleventh aspect of the present invention provides the inkjet recording method according to the tenth aspect, wherein in the jetting, the jetting heads are used to jet the photocurable color inks in descending order of light blocking effect.

According to this method, when the light applied from the irradiation device strikes the layered ink, the light passes through from the top layer side to the deep layer side of the layered ink—that is, the light passes through in order beginning with the ink layer having the small light blocking effect. Because of this, the light can be kept from being blocked at the top layer side of the layered ink, and the amount of light passing through to the deep layer side of the layered ink can be increased. As a result, photocuring proceeds to the ink layers on the deep layer side of the layered ink, and the film strength of the layered ink becomes higher.

According to the present invention, there can be provided an inkjet recording apparatus and an inkjet recording method that can raise the film strength of layered ink when layer jetting photocurable color inks onto a recording medium.

BRIEF DESCRIPTION OF THE DRAWINGS

An exemplary embodiment of the present invention will be described in detail based on the following figures, wherein.

DETAILED DESCRIPTION

An example of an embodiment pertaining to the present invention will be described below with reference to the drawings.

—Apparatus Configuration—

Figure 1:
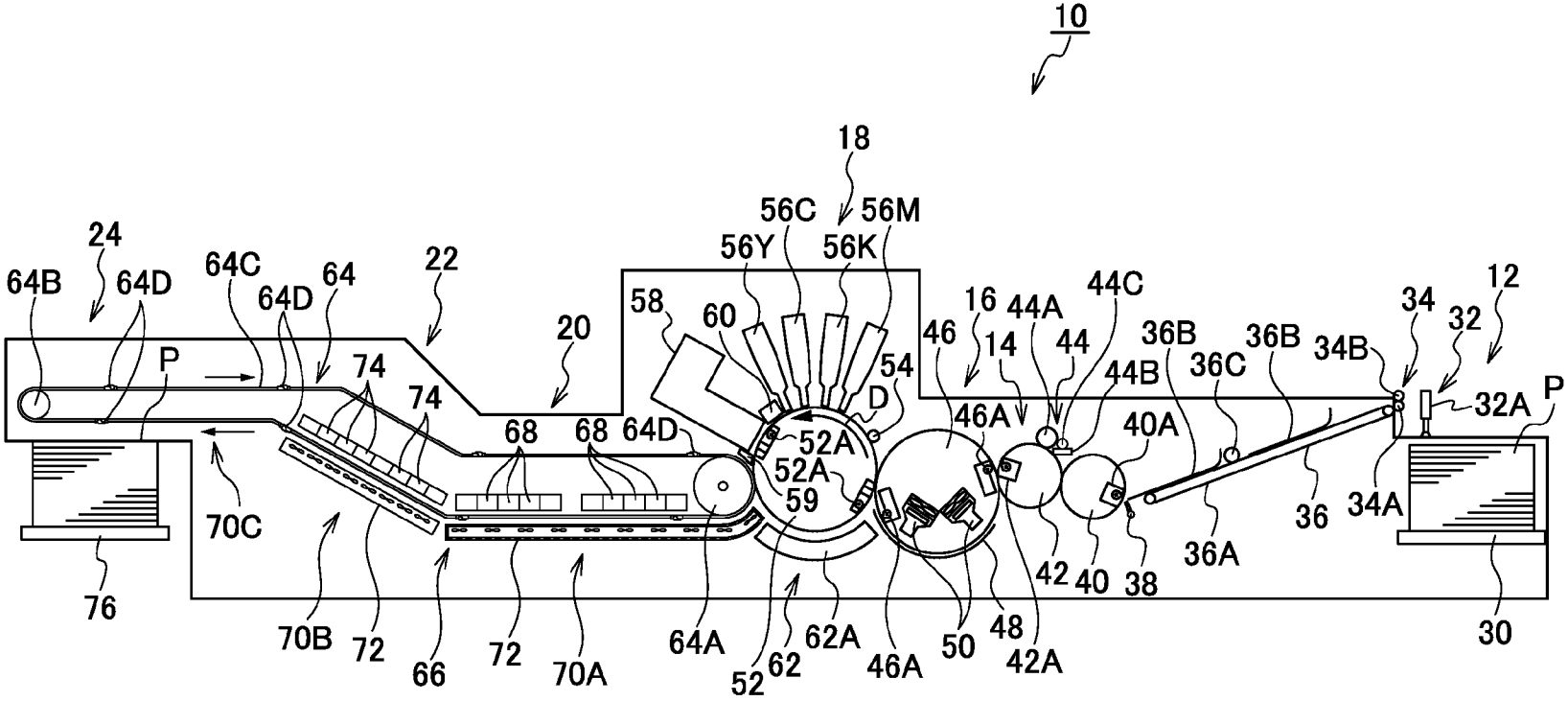
FIG. 1 is an overall configuration diagram of an inkjet recording apparatus pertaining to the embodiment of the present invention.

FIG. 1 is an overall configuration diagram of an inkjet recording apparatus 10 pertaining to the embodiment of the present invention.

The inkjet recording apparatus 10 of the present embodiment is an inkjet recording apparatus that uses aqueous UV inks (ultraviolet (UV)-curable inks using an aqueous medium) to record an image by the inkjet method on paper sheets (recording medium) P. The inkjet recording apparatus 10 is mainly equipped with a paper feed section 12 that feeds the paper sheets P, a process liquid application section 14 that applies a predetermined process liquid to front surfaces (image recording surfaces) of the paper sheets P that have been fed from the paper feed section 12, a process liquid drying treatment section 16 that administers a drying treatment to the paper sheets P to which the process liquid has been applied by the process liquid application section 14, an image recording section 18 that uses aqueous UV inks to record an image by the inkjet method on the front surfaces of the paper sheets P to which the drying treatment has been administered by the process liquid drying treatment section 16, an ink drying treatment section 20 that administers a drying treatment to the paper sheets P on which the images have been recorded by the image recording section 18, a UV irradiation treatment section 22 that administers a UV irradiation treatment (fixing treatment) to the paper sheets P to thereby fix the images, and a paper discharge section 24 that discharges the paper sheets P to which the UV irradiation treatment has been administered by the UV irradiation treatment section 22.

(Paper Feed Section)

The paper feed section 12 feeds the paper sheets P, which are stacked in a paper feed tray 30, one sheet at a time to the process liquid application section 14. The paper feed section 12 that serves as an example of a paper feed section is mainly configured by the paper feed tray 30, a sucker device 32, a paper feed roller pair 34, a feeder board 36, a feed guide 38, and a paper feed drum 40.

The paper sheets P are placed in the paper feed tray 30 as a stack in which numerous sheets are stacked on top of each other. The paper feed tray 30 is disposed in such a way that it can be raised and lowered by an unillustrated paper feed tray raising-and-lowering device. The driving of the paper feed tray raising-and-lowering device is controlled in conjunction with increases and decreases in the number of the paper sheets P stacked in the paper feed tray 30. The paper feed tray raising-and-lowering device raises and lowers the paper feed tray 30 in such a way that the paper sheet P positioned in the uppermost position of the stack is always positioned at a fixed height.

The paper sheets P that serve as the recording medium are not particularly limited, and general-purpose printing paper (paper mainly consisting of cellulose, such as so-called wood-free paper, coated paper, and art paper) used in common offset printing and so forth can be used.

The sucker device 32 picks up, one sheet at a time sequentially from above, the paper sheets P stacked in the paper feed tray 30 and feeds the paper sheets P to the paper feed roller pair 34. The sucker device 32 is equipped with a suction foot 32A that is disposed in such a way that it may be freely raised and lowered and freely swung. The sucker device 32 sucks and holds the upper surface of the paper sheet P with the suction foot 32A and transfers the paper sheet P from the paper feed tray 30 to the paper feed roller pair 34. At this time, the suction foot 32A sucks and holds the upper surface on the leading end side of the paper sheet P positioned in the uppermost position of the stack, pulls up the paper sheet P, and inserts the leading end of the paper sheet P it has pulled up between a pair of rollers 34A and 34B configuring the paper feed roller pair 34.

The paper feed roller pair 34 is configured by an upper and lower pair of rollers 34A and 34B that are pressed against and brought into contact with each other. One of the upper and lower pair of rollers 34A and 34B is configured to serve as a drive roller (the roller 34A) and the other is configured to serve as a driven roller (the roller 34B). The drive roller (the roller 34A) is driven to rotate by an unillustrated motor. The motor is driven in conjunction with the feeding of the paper sheet P, and when the paper sheet P is fed from the sucker device 32, the motor causes the drive roller (the roller 34A) to rotate in accordance with the timing of the feeding. The paper sheet P that has been inserted between the upper and lower pair of rollers 34A and 34B is nipped by the rollers 34A and 34B and is fed in the direction of rotation of the rollers 34A and 34B (the installation direction of the feeder board 36).

The feeder board 36 is formed in correspondence to the width of the paper sheets P, receives the paper sheet P that has been fed from the paper feed roller pair 34, and guides the paper sheet P to the feed guide 38. The feeder board 36 is installed in such a way as to incline downward, allows the paper sheet P that has been placed on top of its conveyance surface to slide along the conveyance surface, and guides the paper sheet P to the feed guide 38.

Tape feeders 36A for conveying the paper sheet P are plurally installed, at intervals apart from each other in the width direction, on the feeder board 36. The tape feeders 36A are formed in endless shapes and are driven to rotate by an unillustrated motor. The paper sheet P that has been placed on the conveyance surface of the feeder board 36 is fed by the tape feeders 36A and is conveyed on top of the feeder board 36.

Further, retainers 36B and a roller 36C are installed on top of the feeder board 36. The retainers 36B are plurally placed in a longitudinal row upstream and downstream along a conveyance surface of the paper sheet P (in the present example, there are two retainers 36B). The retainers 36B are configured by plate springs that have a width corresponding to the width of the paper sheets P. The retainers 36B are installed in such a way that they are pressed against and brought into contact with the conveyance surface. The paper sheet P conveyed on top of the feeder board 36 by the tape feeders 36A passes through the retainers 36B, whereby unevenness is corrected.

The roller 36C is disposed between the upstream and downstream retainers 36B. The roller 36C is installed in such a way that it is pressed against and brought into contact with the conveyance surface of the paper sheet P. The paper sheet P conveyed between the upstream and downstream retainers 36B is conveyed while its upper surface is held down by the roller 36C.

The feed guide 38 corrects the posture of the paper sheet P. The feed guide 38 is formed in a plate shape and is placed orthogonal to the conveyance direction of the paper sheet P. Further, the feed guide 38 is driven by an unillustrated motor and is disposed in such a way that it can swing. The leading end of the paper sheet P that has been conveyed on top of the feeder board 36 is brought into contact with the feed guide 38, whereby the posture of the paper sheet P is corrected (so-called skew prevention). The feed guide 38 swings in conjunction with the feeding of the paper sheet P to the paper feed drum 40 and transfers the paper sheet P whose posture has been corrected to the paper feed drum 40.

The paper feed drum 40 receives the paper sheet P fed from the feeder board 36 via the feed guide 38 and conveys the paper sheet P to the process liquid application section 14. The paper feed drum 40 is formed in a cylindrical shape and is driven to rotate by an unillustrated motor. A gripper 40A is disposed on the outer peripheral surface of the paper feed drum 40, and the leading end of the paper sheet P is gripped by the gripper 40A. The paper feed drum 40 grips the leading end of the paper sheet P with the gripper 40A and rotates, whereby the paper feed drum 40 wraps the paper sheet P onto its peripheral surface and conveys the paper sheet P to the process liquid application section 14.

(Process Liquid Application Section)

The process liquid application section 14 applies a predetermined process liquid to the front surface (image recording surface) of the paper sheet P. The process liquid application section 14 is mainly configured by a process liquid application drum 42 that conveys the paper sheet P and a process liquid application unit 44 that applies the predetermined process liquid to a printing surface of the paper sheet P conveyed by the process liquid application drum 42. The process liquid applied to the front surface of the paper sheet P is an aggregating agent that has the function of causing color materials (pigments) in the aqueous UV inks ejected onto the paper sheet P by the downstream image recording section 18 to aggregate. By applying the process liquid to the front surface of the paper sheet P and ejecting the aqueous UV ink, high-definition printing can be performed without causing landing interference or the like even in the case of using general-purpose printing paper.

The process liquid application drum 42 receives the paper sheet P from the paper feed drum 40 of the paper feed section 12 and conveys the paper sheet P to the process liquid drying treatment section 16. The process liquid application drum 42 is formed in a cylindrical shape and is driven to rotate by an unillustrated motor. A gripper 42A is disposed on the outer peripheral surface of the process liquid application drum 42, and the leading end of the paper sheet P is gripped by the gripper 42A. The process liquid application drum 42 grips the leading end of the paper sheet P with the gripper 42A and rotates, whereby the process liquid application drum 42 wraps the paper sheet P onto its peripheral surface and conveys the paper sheet P to the process liquid drying treatment section 16 (the process liquid application drum 42 conveys one paper sheet P by one rotation). The rotation of the process liquid application drum 42 and the rotation of the paper feed drum 40 are controlled in such a way that the timing of the receipt of the paper sheet P by the process liquid application drum 42 and the timing of the transfer of the paper sheet P by the paper feed drum 40 coincide. That is, the process liquid application drum 42 and the paper feed drum 40 are driven in such a way that they have the same circumferential speed and are driven in such a way that the positions of their respective grippers coincide.

The process liquid application unit 44 applies the process liquid by means of a roller to the front surface of the paper sheet P conveyed by the process liquid application drum 42. The process liquid application unit 44 is mainly configured by an application roller 44A that applies the process liquid to the paper sheet P, a process liquid tank 44B in which the process liquid is stored, and a draw roller 44C that draws up the process liquid stored in the process liquid tank 44B and supplies the process liquid to the application roller 44A.

In the present example, the process liquid application unit 44 is given a configuration that applies the process liquid by means of a roller, but the method of applying the process liquid is not limited to this. In addition to this, a configuration that uses an inkjet head to apply the process liquid and a configuration that applies the process liquid by spraying the process liquid can also be employed.

(Process Liquid Drying Treatment Section)

The process liquid drying treatment section 16 administers a drying treatment to the paper sheet P to whose front surface the process liquid has been applied. The process liquid drying treatment section 16 is mainly configured by a process liquid drying treatment drum 46 that conveys the paper sheet P, a paper sheet conveyance guide 48, and a process liquid drying treatment unit 50 that blows dry air onto the printing surface of the paper sheet P conveyed by the process liquid drying treatment drum 46 to thereby dry the printing surface of the paper sheet P.

The process liquid drying treatment drum 46 receives the paper sheet P from the process liquid application drum 42 of the process liquid application section 14 and conveys the paper sheet P to the image recording section 18. The process liquid drying treatment drum 46 is configured by a frame body assembled in a cylindrical shape and is driven to rotate by an unillustrated motor. A gripper 46A is disposed on the outer peripheral surface of the process liquid drying treatment drum 46, and the leading end of the paper sheet P is gripped by the gripper 46A. The process liquid drying treatment drum 46 grips the leading end of the paper sheet P with the gripper 46A and rotates, whereby the process liquid drying treatment drum 46 conveys the paper sheet P to the image recording section 18. The process liquid drying treatment drum 46 of the present example is configured in such a way that the gripper 46A is disposed in two places on the outer peripheral surface of the process liquid drying treatment drum 46 so that two of the paper sheets P can be conveyed by one rotation. The rotation of the process liquid drying treatment drum 46 and the rotation of the process liquid application drum 42 are controlled in such a way that the timing of the receipt of the paper sheet P by the process liquid drying treatment drum 46 and the timing of the transfer of the paper sheet P by the process liquid application drum 42 coincide. That is, the process liquid drying treatment drum 46 and the process liquid application drum 42 are driven in such a way that they have the same circumferential speed and are driven in such a way that the positions of their respective grippers coincide.

The paper sheet conveyance guide 48 is disposed along the conveyance path of the paper sheet P resulting from the process liquid drying treatment drum 46 and guides the conveyance of the paper sheet P.

The process liquid drying treatment unit 50 is installed on the inside of the process liquid drying treatment drum 46 and blows dry air toward the front surface of the paper sheet P conveyed by the process liquid drying treatment drum 46 to thereby administer a drying treatment to the paper sheet P. Because of this, the solvent component in the process liquid is removed and an ink aggregation layer is formed on the front surface of the paper sheet P. In the present example, two of the process liquid drying treatment units 50 are disposed inside the process liquid drying treatment drum 46 and are given a configuration that blows dry air toward the front surface of the paper sheet P conveyed by the process liquid drying treatment drum 46.

(Image Recording Section)

The image recording section 18 ejects liquid droplets of aqueous ultraviolet-curable color inks (aqueous UV inks) of the colors of M, K, C, and Y onto the printing surface of the paper sheet P to thereby form a color image on the printing surface of the paper sheet P. The image recording section 18 is mainly configured by an image recording drum 52 that conveys the paper sheet P, a paper sheet holding roller 54 that presses the paper sheet P conveyed by the image recording drum 52 to thereby bring the paper sheet P into close contact with the peripheral surface of the image recording drum 52, inkjet heads 56M, 56K, 56C, and 56Y that serve as an example of jetting heads that jet ink droplets of the colors of M, K, C, and Y onto the paper sheet P, an inline sensor 58 that reads the image that has been recorded on the paper sheet P, a mist filter 60 that traps ink mist, and a drum cooling unit 62. As mentioned above, aqueous UV inks are used for the inks jetted from the inkjet heads 56M, 56K, 56C, and 56Y. The aqueous UV inks can be cured by irradiating them with ultraviolet (UV) light after the aqueous UV inks have been ejected.

The image recording drum 52 receives the paper sheet P from the process liquid drying treatment drum 46 of the process liquid drying treatment section 16 and conveys the paper sheet P to the ink drying treatment section 20. The image recording drum 52 is formed in a cylindrical shape and is driven to rotate by an unillustrated motor. A gripper 52A is disposed on the outer peripheral surface of the image recording drum 52, and the leading end of the paper sheet P is gripped by the gripper 52A. The image recording drum 52 grips the leading end of the paper sheet P with the gripper 52A and rotates, whereby the image recording drum 52 wraps the paper sheet P onto its peripheral surface and conveys the paper sheet P to the ink drying treatment section 20. Further, numerous suction holes (not shown in the drawings) are formed in a predetermined pattern in the peripheral surface of the image recording drum 52. The paper sheet P that has been wrapped onto the peripheral surface of the image recording drum 52 is sucked from the section holes, whereby the paper sheet P is conveyed while being sucked and held on the peripheral surface of the image recording drum 52. Because of this, the paper sheet P can be conveyed with a high degree of smoothness.

The suction from the suction holes acts only in a fixed range and acts between a predetermined start-of-suction position and a predetermined end-of-suction position. The start-of-suction position is set in the installation position of the paper sheet holding roller 54, and the end-of-suction position is set on the downstream side of the installation position of the inline sensor 58 (e.g., the end-of-suction position is set in the position at which the image recording drum 52 transfers the paper sheet P to the ink drying treatment section 20). That is, the start-of-suction position and the end-of-suction position are set in such a way that the paper sheet P is sucked and held on the peripheral surface of the image recording drum 52 at least in the installation position of the inkjet heads 56M, 56K, 56C, and 56Y (which is an image recording position) and the installation position of the inline sensor 58 (which is an image reading position).

The mechanism by which the paper sheet P is sucked and held on the peripheral surface of the image recording drum 52 is not limited to the suction method resulting from negative pressure described above and can also employ a method resulting from electrostatic attraction.

Further, the image recording drum 52 of the present example is configured in such a way that the gripper 52A is disposed in two places on the outer peripheral surface so that two of the paper sheets P can be conveyed by one rotation. The rotation of the image recording drum 52 and the rotation of the process liquid drying treatment drum 46 are controlled in such a way that the timing of the receipt of the paper sheet P by the image recording drum 52 and the timing of the transfer of the paper sheet P by the process liquid drying treatment drum 46 coincide. That is, the image recording drum 52 and the process liquid drying treatment drum 46 are driven in such a way that they have the same circumferential speed and are driven in such a way that the positions of their respective grippers coincide.

The paper sheet holding roller 54 is disposed in the neighborhood of a paper sheet receiving position of the image recording drum 52 (the position at which the image recording drum 52 receives the paper sheet P from the process liquid drying treatment drum 46). The paper sheet holding roller 54 is configured by a rubber roller and is installed in such a way that it is pressed against and brought into contact with the peripheral surface of the image recording drum 52. The paper sheet P that has been transferred from the process liquid drying treatment drum 46 to the image recording drum 52 is nipped and brought into close contact with the peripheral surface of the image recording drum 52 as a result of passing through the paper sheet holding roller 54.

The four inkjet heads 56M, 56K, 56C, and 56Y are placed at fixed intervals apart from each other along the conveyance path of the paper sheet P resulting from the image recording drum 52.

The inkjet heads 56M, 56K, 56C, and 56Y are configured by line heads corresponding to the width of the paper sheets P and are placed in such a way that their nozzle surfaces oppose the peripheral surface of the image recording drum 52. The inkjet heads 56M, 56K, 56C, and 56Y jet liquid droplets of aqueous UV inks toward the image recording drum 52 from nozzle rows formed in their nozzle surfaces to thereby record an image on the paper sheet P conveyed by the image recording drum 52.

Further, in the present embodiment, the inkjet heads 56M, 56K, 56C, and 56Y are placed from upstream to downstream in a conveyance direction D of the paper sheet P in such a way as to jet the aqueous UV inks in descending order of ultraviolet blocking effect (in the order of magenta, black, cyan, and yellow). Further, the plural inkjet heads 56M, 56K, 56C, and 56Y have a configuration where, when the plural inkjet heads 56M, 56K, 56C, and 56Y layer-jet the different types of aqueous UV inks onto the paper sheet P, the plural inkjet heads 56M, 56K, 56C, and 56Y jet the aqueous UV inks in the order of the inkjet head 56M, the inkjet head 56K, the inkjet head 56C, and the inkjet head 56Y. Because of this, when the plural inkjet heads 56M, 56K, 56C, and 56Y layer-jet the aqueous UV inks, the plural inkjet heads 56M, 56K, 56C, and 56Y jet the aqueous UV inks in descending order of ultraviolet blocking effect.

The details of the aqueous UV inks that are jetted will be described later. Further, "layer-jetting" means jetting in such a way that the different types of aqueous UV inks become layered on top of each other in the thickness direction of the paper sheet P. The aqueous UV inks of all the inkjet heads 56M, 56K, 56C, and 56Y may be layered, or the aqueous UV inks of some of the heads may be layered. Moreover, the descending order of the ultraviolet blocking effect of the aqueous UV inks changes depending on the material of the photopolymerization initiator, the material of the pigments, and the concentration of the pigments, so the order is not limited to the order of magenta, black, cyan, and yellow. In the present embodiment, the descending order of the ultraviolet blocking effect of the aqueous UV inks will be the order of the magenta, black, cyan, and yellow aqueous inks.

Further, to state the above-described jetting configuration differently, the image recording section 18 has a configuration equipped with a first inkjet head (e.g., the inkjet head 56M) that first jets the aqueous UV ink having the largest ultraviolet blocking effect when layer-jetting the different types of aqueous UV inks onto the paper sheet P, a second inkjet head (e.g., the inkjet head 56K) that jets the aqueous UV ink having the next largest ultraviolet blocking effect in such a way that the aqueous UV ink having the second largest ultraviolet blocking effect becomes layered in the thickness direction of the paper P on the aqueous UV ink that was jetted first, a third inkjet head (e.g., the inkjet head 56C) that jets the aqueous UV ink having the third largest ultraviolet blocking effect in such a way that the aqueous UV ink having the third largest ultraviolet blocking effect becomes layered in the thickness direction of the paper sheet P on the aqueous UV ink that was jetted second, and so forth.

Stated even more differently, the image recording section 18 has a configuration that implements an inkjet recording method having a jetting step of using the plural inkjet heads 56M, 56K, 56C, and 56Y to first jet the aqueous UV ink having the largest ultraviolet blocking effect among the plural aqueous UV inks that the plural inkjet heads 56M, 56K, 56C, and 56Y layer-jet and to thereafter jet the remaining aqueous UV inks in descending order of light blocking effect in such a way that the remaining aqueous UV inks become layered on the photocurable color ink having the largest ultraviolet blocking effect. After the jetting step, as will be described later, the image recording section 18 implements an irradiation step of using an irradiation device to apply light to the aqueous UV inks that have been layer-jetted onto the paper sheet P.

It is preferred that the plural inkjet heads 56M, 56K, 56C, and 56Y be set in such a way as to jet the aqueous UV inks in such a way that the total amount of the aqueous UV inks on the paper P becomes a maximum or 15 $ml/m^2$ or less. This is so that the curability of the aqueous UV inks by the UV irradiation treatment section 22 can be ensured in the apparatus configuration of the present embodiment.

The inline sensor 58 is installed on the downstream side of the last inkjet head 56Y with respect to the conveyance direction of the paper sheet P resulting from the image recording drum 52 and reads the image that has been recorded by the inkjet heads 56M, 56K, 56C, and 56Y. The inline sensor 58 is configured by a line scanner, for example, and reads the image that has been recorded by the inkjet heads 56M, 56K, 56C, and 56Y from the paper sheet P conveyed by the image recording drum 52.

A contact prevention plate 59 is installed on the downstream side of the inline sensor 58 in proximity to the line sensor 58. The contact prevention plate 59 prevents the paper sheet P from contacting the inline sensor 58 in a case where lift has occurred in the paper sheet P due to conveyance trouble or the like.

The mist filter 60 is disposed between the last inkjet head 56Y and the inline sensor 58 and sucks in the air around the image recording drum 52 to trap ink mist. In this way, by sucking in the air around the image recording drum 52 to trap ink mist, the ingress of ink mist into the inline sensor 58 can be prevented and the occurrence of reading defects and so forth can be prevented.

The drum cooling unit 62 blows cold air onto the image recording drum 52 to thereby cool the image recording drum 52. The drum cooling unit 62 is mainly configured by an air conditioner (not shown in the drawings) and a duct 62A that blows cold air supplied from the air conditioner onto the peripheral surface of the image recording drum 52. The duct 62A blows the cold air onto a region of the image recording drum 52 outside the region that conveys the paper sheet P to thereby cool the image recording drum 52. In the present example, the paper sheet P is conveyed along a circular arc surface substantially on the upper half of the image recording drum 52, so the duct 62A is given a configuration that blows the cold air onto the region of substantially the lower half of the image recording drum 52 to thereby cool the image recording drum 52. Specifically, the duct 62A is given a configuration where the air outlet of the duct 62A is formed in a circular arc shape in such a way as to cover substantially the lower half of the image recording drum 52 and the cold air is blown onto the region of substantially the lower half of the image recording drum 52.

Here, the temperature to which the drum cooling unit 62 cools the image recording drum 52 is determined by its relationship to the temperature of the inkjet heads 56M, 56K, 56C, and 56Y (particularly the temperature of the nozzle surfaces), and the image recording drum 52 is cooled in such a way that its temperature becomes lower than the temperature of the inkjet heads 56M, 56K, 56C, and 56Y. Because of this, dew condensation can be prevented from forming on the inkjet heads 56M, 56K, 56C, and 56Y. That is, by making the temperature of the image recording drum 52 lower than the temperature of the inkjet heads 56M, 56K, 56C, and 56Y, dew condensation can be induced on the image recording drum 52 side, and dew condensation forming on the inkjet heads 56M, 56K, 56C, and 56Y (particularly dew condensation forming on their nozzle surfaces) can be prevented.

(Ink Drying Treatment Section)

The ink drying treatment section 20 administers a drying treatment to the paper sheet P after image recording to remove the liquid component remaining on the recording surface of the paper sheet P. The ink drying treatment section 20 is mainly configured by a chain gripper 64 that conveys the paper sheet P on which the image has been recorded, a back tension application mechanism 66 that serves as an example of a back tension applying unit that applies back tension to the paper sheet P conveyed by the chain gripper 64, and ink drying treatment units 68 that serve as an example of drying units that administer a drying treatment to the paper sheet P conveyed by the chain gripper 64.

The chain gripper 64 is a paper sheet conveyance mechanism used in common by the ink drying treatment section 20, the UV irradiation treatment section 22, and the paper discharge section 24. The chain gripper 64 receives the paper sheet P that has been transferred from the image recording section 18 and conveys the paper sheet P to the paper discharge section 24.

The chain gripper 64 is mainly configured by a first sprocket 64A that is installed in proximity to the image recording drum 52, a second sprocket 64B that is installed in the paper discharge section 24, an endless chain 64C that is wrapped around the first sprocket 64A and the second sprocket 64B, plural chain guides (not shown in the drawings) that guide the travel of the chain 64C, and plural grippers 64D that are attached at fixed intervals apart from each other to the chain 64C. The first sprocket 64A, the second sprocket 64B, the chain 64C, and the chain guides are each configured in pairs and are disposed on both sides in the width direction of the paper sheet P. The grippers 64D are installed in such a way as to span the chains 64C disposed in a pair.

The first sprocket 64A is installed in proximity to the image recording drum 52 so that the paper sheets P transferred from the image recording drum 52 can be received by the grippers 64D. The first sprocket 64A is supported by an unillustrated bearing, is disposed in such a way that it may freely rotate, and is coupled to an unillustrated motor. The chain 64C wrapped around the first sprocket 64A and the second sprocket 64B travels as a result of the motor being driven.

The second sprocket 64B is installed in the paper discharge section 24 so that the paper sheet P that has been received from the image recording drum 52 can be collected by the paper discharge section 24. That is, the installation position of the second sprocket 64B is configured to be at the terminal end of the conveyance path of the paper sheet P resulting from the chain gripper 64. The second sprocket 64B is supported by an unillustrated bearing and is disposed in such a way that it may freely rotate.

The chain 64C is formed in an endless shape and is wrapped around the first sprocket 64A and the second sprocket 64B.

The chain guides are placed in predetermined positions and guide the chain 64C in such a way that the chain 64C travels a predetermined path (i.e., the chain guides guide the chain 64C in such a way that the paper sheet P travels and is conveyed on a predetermined conveyance path). In the inkjet recording apparatus 10 of the present example, the second sprocket 64B is disposed in a higher position than the first sprocket 64A. For this reason, a traveling path in which the chain 64C inclines midway is formed. Specifically, the traveling path is configured by a first horizontal conveyance path 70A, an inclined conveyance path 70B, and a second horizontal conveyance path 70C.

The first horizontal conveyance path 70A is set to the same height as the first sprocket 64A and is set in such a way that the chain 64C wrapped around the first sprocket 64A travels horizontally. The second horizontal conveyance path 70C is set to the same height as the second sprocket 64B and is set in such a way that the chain 64C wrapped around the second sprocket 64B travels horizontally. The inclined conveyance path 70B is set between the first horizontal conveyance path 70A and the second horizontal conveyance path 70C and is set in such a way as to join the first horizontal conveyance path 70A and the second horizontal conveyance path 70C.

The chain guides are disposed in such a way as to form the first horizontal conveyance path 70A, the inclined conveyance path 70B, and the second horizontal conveyance path 70C. Specifically, the chain guides are disposed at least in the points where the first horizontal conveyance path 70A and the inclined conveyance path 70B join to each other and in the points where the inclined conveyance path 70B and the second horizontal conveyance path 70C join to each other.

The grippers 64D are plurally attached at fixed intervals apart from each other to the chain 64C. The intervals at which the grippers 64D are attached are set in such a way as to correspond to the intervals at which the grippers 64D receive the paper sheets P from the image recording drum 52. That is, the intervals at which the grippers 64D are attached are set in correspondence to the intervals at which the grippers 64D receive the paper sheets P from the image recording drum 52 so that the grippers 64D can match the timing of, and receive from the image recording drum 52, the paper sheets P successively transferred from the image recording drum 52.

The chain gripper 64 is configured as described above. As mentioned above, when the motor (not shown in the drawings) connected to the first sprocket 64A is driven, the chain 64C travels. The chain 64C travels at the same speed as the circumferential speed of the image recording drum 52. Further, the timings are matched in such a way that the paper sheets P transferred from the image recording drum 52 can be received by the grippers 64D.

The back tension application mechanism 66 applies back tension to the paper sheet P that is conveyed with its leading end gripped by the chain gripper 64. The back tension application mechanism 66 is mainly equipped with a guide plate 72 and plural suction fans (not shown in the drawings) that suck in air from numerous suction holes formed in the upper surface of the guide plate 72. Further, numerous holes for blowing out the sucked-in air are disposed in the lower surface of the guide plate 72.

The guide plate 72 is configured by a hollow box plate that has a width corresponding to the width of the paper sheets P. The guide plate 72 is disposed along the conveyance path of the paper sheet P resulting from the chain gripper 64 (i.e., the traveling path of the chain 64C). Specifically, the guide plate 72 is disposed along the chain 64C that travels the first horizontal conveyance path 70A and the inclined conveyance path 70B, and the guide plate 72 is disposed a predetermined distance apart from the chain 64C. The paper sheet P conveyed by the chain gripper 64 is conveyed with its back surface (the surface on the side on which the image is not recorded) sliding on and contacting the top of the upper surface (the surface opposing the chain 64C: a sliding contact surface) of the guide plate 72.

The numerous suction holes are formed in a predetermined pattern in the sliding contact surface (upper surface) of the guide plate 72. As mentioned above, the guide plate 72 is formed by a hollow box plate. The suction fans suck air into the hollow portion (the inside) of the guide plate 72. Because of this, air is sucked in from the suction holes formed in the sliding contact surface.

Air is sucked in from the suction holes in the guide plate 72, whereby the back surface of the paper sheet P conveyed by the chain gripper 64 is sucked by the suction holes. Because of this, back tension is applied to the paper sheet P conveyed by the chain gripper 64.

As mentioned above, the guide plate 72 is disposed along the chain 64C that travels the first horizontal conveyance path 70A and the inclined conveyance path 70B, so back tension is applied while the paper sheet P is conveyed on the first horizontal conveyance path 70A and the inclined conveyance path 70B.

The ink drying treatment units 68 are installed inside the chain gripper 64 (particularly the posterior half side and the anterior half side of the site configuring the first horizontal conveyance path 70A) and administer the drying treatment with respect to the paper sheet P conveyed on the first horizontal conveyance path 70A. It is preferred that the ink drying treatment units 68 dry the paper sheet P in such a way that the water content on the paper sheet P including water in the aqueous UV inks becomes 3.0 $g/m^2$ or less before the application of ultraviolet light by the UV irradiation treatment section 22 by blowing dry air onto the recording surface of the paper sheet P conveyed on the first horizontal conveyance path 70A. This is so that the curability of the aqueous UV inks by the UV irradiation treatment section 22 can be ensured in the apparatus configuration of the present embodiment.

Further, the ink drying treatment units 68 are plurally placed along the first horizontal conveyance path 70A. The number of the ink drying treatment units 68 that are installed is set in accordance with, for example, the processing capability of the ink drying treatment units 68 and the conveyance speed (i.e., the printing speed) of the paper sheet P. That is, the number of the ink drying treatment units 68 that are installed is set in such a way that the paper sheet P that has been received from the image recording section 18 can be dried while the paper sheet P is being conveyed on the first horizontal conveyance path 70A. Consequently, the length of the first horizontal conveyance path 70A is also set in consideration of the capability of the ink drying treatment units 68.

(UV Irradiation Treatment Section)

The UV irradiation treatment section 22 applies ultraviolet (UV) light to the image that has been recorded using the aqueous UV inks to thereby fix the image. The UV irradiation treatment section 22 is mainly configured by the chain gripper 64 that conveys the paper sheet P, the back tension application mechanism 66 that applies back tension to the paper sheet P conveyed by the chain gripper 64, and UV irradiation units 74 that serve as an example of fixing units that apply ultraviolet light to the paper sheet P conveyed by the chain gripper 64.

As mentioned above, the chain gripper 64 and the back tension application mechanism 66 are also used in common by the ink drying treatment section 20 and the paper discharge section 24.

The UV irradiation units 74 are installed inside the chain gripper 64 (particularly in the site configuring the inclined conveyance path 70B) and apply ultraviolet light to the recording surface of the paper sheet P conveyed on the inclined conveyance path 70B. The UV irradiation units 74 are equipped with ultraviolet lamps (UV lamps) and are plurally disposed along the inclined conveyance path 70B. Additionally, the UV irradiation units 74 apply the ultraviolet light toward the recording surface of the paper sheet P conveyed on the inclined conveyance path 70B. The number of the UV irradiation units 74 that are installed is set in accordance with, for example, the conveyance speed (i.e., the printing speed) of the paper sheet P. That is, the number of the UV irradiation units 74 that are installed is set in such a way that the image can be fixed by the ultraviolet light that has been applied while the paper sheet P is being conveyed on the inclined conveyance path 70B. Consequently, the length of the inclined conveyance path 70B is also set in consideration of the conveyance speed of the paper sheet P and so forth.

(Paper Discharge Section)

The paper discharge section 24 collects the paper sheets P on which the series of image recording processes has been performed. The paper discharge section 24 is mainly configured by the chain gripper 64 that conveys the paper sheets P that have been irradiated with ultraviolet light and a paper discharge tray 76 that stacks and collects the paper sheets P.

As mentioned above, the chain gripper 64 is also used in common by the ink drying treatment section 20 and the UV irradiation treatment section 22. The chain gripper 64 releases the paper sheets P above the paper discharge tray 76 and stacks the paper sheets P in the paper discharge tray 76.

The paper discharge tray 76 stacks and collects the paper sheets P that have been released from the chain gripper 64. Paper guides (a front paper guide, a rear paper guide, lateral paper guides, etc.) are disposed on the paper discharge tray 76 so that the paper sheets P are stacked in an orderly manner (not shown in the drawings).

Further, the paper discharge tray 76 is disposed in such a way that it can be raised and lowered by an unillustrated paper discharge tray raising-and-lowering device. The driving of the paper discharge tray raising-and-lowering device is controlled in conjunction with increases and decreases in the number of the paper sheets P stacked in the paper discharge tray 76. The paper discharge tray raising-and-lowering device raises and lowers the paper discharge tray 76 in such a way that the paper sheet P positioned in the uppermost position is always positioned at a fixed height.

(Aqueous UV Inks)

Here, the aqueous UV inks used in the present embodiment will be described. It is preferred that each of the aqueous UV inks include a pigment, polymer particles, a water-soluble polymerizable compound that is polymerized by an active energy ray, and a photopolymerization initiator. Because of this, the aqueous UV inks can be cured by irradiating them with ultraviolet light, the aqueous UV inks have good abrasion resistance, and the film strength becomes higher. Dyes may also be included as color materials.

In a case where pigments are included in the aqueous UV inks, the aqueous UV inks can be configured further using a dispersant, a surfactant, and other components as needed. The aqueous UV inks contain at least one type of pigment as the color material component. There are no particular restrictions on the pigment, and the pigment can be appropriately selected in accordance with the purpose. For example, the pigment may be an organic pigment or an inorganic pigment. In terms of ink colorability, the pigment is preferably a pigment that is virtually insoluble or sparingly soluble in water. Further, the pigment is preferably a water-dispersible pigment where at least part of its surface is covered by a polymer dispersant.

Further, the aqueous UV inks can contain at least one type of dispersant. The dispersant for the pigment may be a polymer dispersant or a low molecular weight surfactant dispersant. Further, the polymer dispersant may be a water-soluble dispersant or a non-water-soluble dispersant.

The weight average molecular weight of the polymer dispersant is preferably 3,000 to 100,000, more preferably 5,000 to 50,000, even more preferably 5,000 to 40,000, and particularly preferably 10,000 to 40,000.

The acid value of the polymer dispersant is preferably equal to or less than 100 mg KOH/g from the standpoint of achieving good aggregability upon contact with the process liquid. Moreover, the acid value is more preferably 25 to 100 mg KOH/g, even more preferably 25 to 80 mg KOH/g, and particularly preferably 30 to 65 mg KOH/g. When the acid value of the polymer dispersant is equal to or greater than 25, the stability of self-dispersal is good.

From the standpoint of self-dispersal and aggregation speed upon contact with the process liquid, the polymer dispersant preferably includes a polymer having a carboxyl group and more preferably includes a polymer having a carboxyl group and an acid value of 25 to 80 mg KOH/g.

In the present embodiment, from the standpoint of the light resistance and quality of the image, the aqueous UV inks preferably include a pigment and a dispersant, more preferably include an organic pigment and a polymer dispersant, and particularly preferably include an organic pigment and a polymer dispersant that includes a carboxyl group. Further, the pigment is preferably covered by a polymer dispersant having a carboxyl group from the standpoint of aggregability and is water-insoluble. Moreover, from the standpoint of aggregability, the acid value of the particles of a later-described self-dispersing polymer is preferably smaller than the acid value of the polymer dispersant.

The average particle size of the pigment is preferably 10 to 200 nm, more preferably 10 to 150 nm, and even more preferably 10 to 100 nm. When the average particle size is equal to or less than 200 nm, color reproducibility is good and droplet ejection characteristics when ejecting droplets by the inkjet method are good. When the average particle size is equal to or less than 100 nm, light resistance is good. Further, in relation to the particle size distribution of the color material, there are no particular restrictions, and the particle size distribution may be a wide particle size distribution or a monodisperse particle size distribution. Further, two or more types of color materials having a monodisperse particle size distribution may also be mixed together and used.

The average particle size and the particle size distribution of the pigment particles are found by measuring the volume average particle size by dynamic light scattering using the Nanotrac particle size distribution analyzer UPA-EX150 (made by Nikkiso Co., Ltd.).

One type of pigment may be used alone or two or more types of pigments may be combined and used. From the standpoint of image density, the content of the pigment in the aqueous UV inks is preferably 1 to 25 mass percent, more preferably 2 to 20 mass percent, even more preferably 5 to 20 mass percent, and particularly preferably 5 to 15 mass percent with respect to the aqueous UV inks.

Further, the aqueous UV inks in the present embodiment can contain at least one type of polymer particle. The polymer particles have the function of fixing the aqueous UV inks by destabilizing dispersion upon contact with the later-described process liquid or the region where the process liquid has been dried, causing aggregation, and increasing the viscosity of the ink. The polymer particles can further improve the fixability of the aqueous UV inks to the paper sheet P and the abrasion resistance of the image.

In order to react with the aggregating agent, polymer particles having an anionic surface charge are used, and widely commonly known latex is used to the extent that sufficient reactivity and jetting stability are obtained, but using self-dispersing polymer particles is particularly preferred.

The aqueous UV inks in the present embodiment preferably contain at least one type of self-dispersing polymer particle as the polymer particles. The self-dispersing polymer particles have the function of fixing the aqueous UV inks by destabilizing dispersion upon contact with the later-described process liquid or the region where the process liquid has been dried, causing aggregation, and increasing the viscosity of the ink. The self-dispersing polymer particles can further improve the fixability of the aqueous UV inks to the paper sheet P and the abrasion resistance of the image. Further, the self-dispersing polymer particles are resin particles, which are preferred from the standpoint of jetting stability and the liquid stability (particularly dispersion stability) of the system including the pigment.

"Self-dispersing polymer particles" means particles of a water-insoluble polymer that does not contain a free emulsifier and which can be obtained as a dispersion in an aqueous medium due to the functional group (particularly an acid group or salt thereof) that the polymer itself has, without the presence of another surfactant.

The acid value of the self-dispersing polymer in the present embodiment is preferably equal to or less than 50 mg KOH/g from the standpoint of achieving good aggregability upon contact with the process liquid. Moreover, the acid value is more preferably 25 to 50 mg KOH/g and even more preferably 30 to 50 mg KOH/g. When the acid value of the self-dispersing polymer is equal to or greater than 25 mg KOH/g, the stability of self-dispersal is good.

From the standpoint of self-dispersal and aggregation speed upon contact with the process liquid, the particles of the self-dispersing polymer in the present embodiment preferably include a polymer having a carboxyl group, more preferably include a polymer having a carboxyl group and an acid value of 25 to 50 mg KOH/g, and even more preferably include a polymer having a carboxyl group and an acid value of 30 to 50 mg KOH/g.

As for the molecular weight of the water-insoluble polymer configuring the particles of the self-dispersing polymer, the weight average molecular weight is preferably 3,000 to 200,000, more preferably 5,000 to 150,000, and even more preferably 10,000 to 100,000. By making the weight average molecular weight equal to or greater than 3,000, the amount of the water-soluble component can be effectively suppressed. Further, by making the weight average molecular weight equal to or less than 200,000, self-dispersal stability can be enhanced.

The weight average molecular weight is measured by gel permeation chromatography (GPC). GPC is performed using the HLC-8220 GPC (made by Tosoh Corporation), using three columns of TSKgel Super HZM-H, TSKgel Super HZ4000, and TSKgel Super HZ2000 (made by Tosoh Corporation, 4.6 mm ID×15 cm), and using an eluent of THF (tetrahydrofuran). Further, as for the conditions, the sample concentration is 0.35/min., the flow rate is 0.35 ml/min., the sample injection amount is 10 μl, and the measurement temperature is 40° C. GPC is performed using an IR detector.

Further, a calibration curve is created from eight samples made by Tosoh Corporation: "standard sample TSK standard, polystyrene", "F-40", "F-20", "F-4", "F-1", "A-5000", "A-2500", "A-1000", and "n-propyl benzene".

As for the average particle size of the particles of the self-dispersing polymer, the volume average particle size is preferably in the range of 10 to 400 nm, more preferably in the range of 10 to 200 nm, and even more preferably in the range of 10 to 100 nm. When the volume average particle size is equal to or greater than 10 nm, manufacturing suitability improves. When the volume average particle size is equal to or less than 1 μm, storage stability improves.

The average particle size and the particle size distribution of the particles of the self-dispersing polymer are found by measuring the volume average particle size by dynamic light scattering using the Nanotrac particle size distribution analyzer UPA-EX150 (made by Nikkiso Co., Ltd.).

One type of self-dispersing polymer particle can be used alone, or two or more types of self-dispersing polymer particles can be mixed together and used. From the standpoint of aggregation speed and image luster, the content of the particles of the self-dispersing polymer in the aqueous UV inks is preferably 1 to 30 mass percent and more preferably 5 to 15 mass percent with respect to the aqueous UV inks.

Further, from the standpoint of the abrasion resistance of the image, the content ratio between the pigment and the particles of the self-dispersing polymer in the aqueous UV inks (e.g., water-insoluble pigment particles/particles of self-dispersing polymer) is preferably 1/0.5 to 1/10 and more preferably 1/1 to 1/4.

The aqueous UV inks in the present embodiment can contain at least one type of water-soluble polymerizable compound that is polymerized by an active energy ray. The polymerizable compound is preferably a non-ionic or cationic polymerizable compound in terms of not hindering the reaction between the aggregating agent and the pigment and polymer particles. Further, "water-soluble" means that a fixed concentration or more is able to be dissolved in water, and it suffices for the polymerizable compound to be a polymerizable compound that can be dissolved (preferably uniformly) in the aqueous inks Further, the polymerizable compound may also be a polymerizable compound whose solubility is increased by adding a water-soluble organic solvent and which dissolves (preferably uniformly) in the ink Specifically, the solubility of the polymerizable compound with respect to water is preferably equal to or greater than 10 mass percent and more preferably equal to or greater than 15 mass percent.

In terms of not hindering the reaction between the aggregating agent and the pigment and polymer particles, the polymerizable compound is preferably a non-ionic or cationic polymerizable compound and is preferably a polymerizable compound whose solubility with respect to water is equal to or greater than 10 mass percent (and more preferably equal to or greater than 15 mass percent).

The polymerizable compound in the present embodiment is preferably a polyfunctional monomer from the standpoint of being able to enhance abrasion resistance. The polymerizable compound is preferably a bifunctional to hexafunctional monomer, and is a preferably a bifunctional to quadrifunctional monomer from the standpoint of achieving a balance between solubility and abrasion resistance. The aqueous UV inks can contain one type of polymerizable compound alone or can contain a combination of two or more types of polymerizable compounds.

The content of the polymerizable compound in the aqueous UV inks is preferably 30 to 300 mass percent and more preferably 50 to 200 mass percent with respect to the combined total solid content of the pigment and the particles of the self-dispersing polymer. When the content of the polymerizable compound is equal to or greater than 30 mass percent, image strength improves more and the image has good abrasion resistance. When the content of the polymerizable compound is equal to or less than 300 mass percent, this is advantageous in terms of pile height.

At least one of the aqueous UV inks and the process liquid further includes an initiator that initiates the polymerization of the polymerizable compound by an active energy ray.

The aqueous UV inks in the present embodiment can contain, with or without also being contained in the process liquid, at least one type of photopolymerization initiator that initiates the polymerization of the polymerizable compound by an active energy ray. One type of photopolymerization initiator can be used alone, or two or more types of photopolymerization initiators can be mixed together and used, and the photopolymerization initiator can be used together with a sensitizer.

For the photopolymerization initiator, a compound that can initiate the polymerization reaction by an active energy ray can be appropriately selected and contained. For example, an initiator that generates an active species (radical, acid, salt, base, etc.) upon exposure to radiation or light or an electron beam (e.g., a photopolymerization initiator) can be used.

In a case where the aqueous UV inks contain a photopolymerization initiator, the content of the initiator in the aqueous UV inks is preferably 1 to 40 mass percent and more preferably 5 to 30 mass percent with respect to the polymerizable compound. When the content of the initiator is equal to or greater than 1 mass percent, the abrasion resistance of the image improves more, which is advantageous for high-speed recording. When the content of the initiator is equal to or greater than 40 mass percent, this is advantageous in terms of jetting stability.

The aqueous UV inks in the present embodiment can contain at least one type of water-soluble organic solvent. The water-soluble organic solvent can obtain an anti-drying, wetting, or penetration enhancing effect. For anti-drying, the water-soluble organic solvent is used as an anti-drying agent that prevents a situation where the ink adheres to and dries in the ink jetting ports of the jetting nozzles such that aggregates form and clog the ink jetting ports. For anti-drying and wetting, a water-soluble organic solvent whose vapor pressure is lower than that of water is preferred. Further, for penetration enhancement, the water-soluble organic solvent can be used as a penetration enhancer that enhances the penetration of the ink into the paper.

The anti-drying agent is preferably a water-soluble organic solvent whose vapor pressure is lower than that of water. One type of anti-drying agent may be used alone, or two or more types of anti-drying agents may be used together. The content of the anti-drying agent is preferably in the range of 10 to 50 mass percent in the aqueous UV inks.

The penetration enhancer is suitable for the purpose of allowing the aqueous UV inks to better penetrate the paper sheet P. One type of penetration enhancer may be used alone, or two or more types of penetration enhancers may be used together. The content of the penetration enhancer is preferably in the range of 5 to 30 mass percent in the aqueous UV inks Further, the penetration enhancer is preferably used in the range of an amount that does not cause image bleeding or print-through.

Further, the aqueous UV inks in the present embodiment contain water, but there are no particular restrictions on the amount of the water. The preferred content of water is 10 to 99 mass percent, more preferably 30 to 80 mass percent, and even more preferably 50 to 70 mass percent.

Further, the aqueous UV inks in the present embodiment can be configured using other additives in addition to the components described above. Example of other additives include publicly known additives such as anti-drying agents (wetting agents), anti-fading agents, emulsion stabilizers, penetration enhancers, UV absorbers, preservatives, antifungal agents, pH modifiers, surface tension modifiers, defoamers, viscosity modifiers, dispersants, dispersion stabilizers, corrosion inhibitors, and chelating agents.

Further, the aqueous UV inks in the present embodiment preferably include a common photopolymerization initiator and different types (colors) of pigments. In this case, when the plural inkjet heads 56M, 56K, 56C, and 56Y layer-jet the aqueous UV inks, it is preferred that the plural inkjet heads 56M, 56K, 56C, and 56Y first jet the aqueous UV ink whose pigment has the largest ultraviolet absorption intensity in the ultraviolet wavelength range in which the ultraviolet absorption intensity of the photopolymerization initiator reaches a peak. Further, when the plural inkjet heads 56M, 56K, 56C, and 56Y layer-jet the aqueous UV inks, it is preferred that the plural inkjet heads 56M, 56K, 56C, and 56Y jet the plural aqueous UV inks in descending order of the ultraviolet absorption intensities of the pigments in the ultraviolet wavelength range in which the ultraviolet absorption intensity of the photopolymerization initiator reaches a peak.

Figure 2:
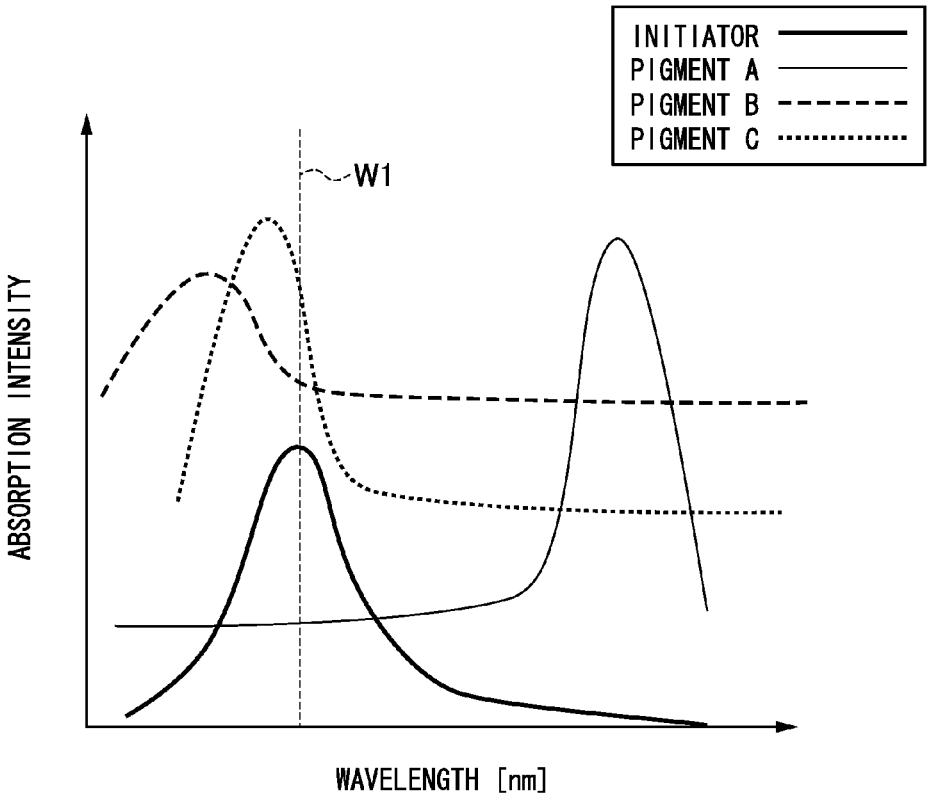
FIG. 2 is a diagram showing ultraviolet absorption characteristics of a photopolymerization initiator included in common in aqueous UV inks and pigments A, B, and C included as respectively different color materials in the aqueous UV inks.

This is because of the following reasons. FIG. 2 is diagram showing ultraviolet absorption characteristics of the photopolymerization initiator included in common in the aqueous UV inks and pigments A, B, and C included as respectively different color materials in the aqueous UV inks.

The photopolymerization initiator common to the plural aqueous UV inks generates radicals upon exposure to ultraviolet energy. The radicals react with the reactive group of the monomer or oligomer in the aqueous UV inks, initiate polymerization, and cause the curing of the aqueous UV inks to proceed. For this reason, for example, as shown in FIG. 2, if the ultraviolet absorption intensity of the pigment is large in wavelength W1 (range) in which the ultraviolet absorption intensity of the photopolymerization initiator reaches a peak, the ultraviolet light ends up being blocked by the pigment, the radical generation rate of the photopolymerization initiator drops, and curability drops.

Therefore, in the case of the ultraviolet absorption characteristics shown in FIG. 2, let us suppose that an aqueous UV ink AI including the pigment A and the common photopolymerization initiator, an aqueous UV ink BI including the pigment B and the common photopolymerization initiator, and an aqueous UV ink CI including the pigment C and the common photopolymerization initiator are all to be layer jetted. In this case, it is preferred that the aqueous UV inks be jetted in descending order of the ultraviolet absorption intensities of the pigments of the aqueous UV inks—that is, in the order of the aqueous UV ink AI, the aqueous UV ink BI, and the aqueous UV ink CI—in the ultraviolet wavelength W1 in which the ultraviolet absorption intensity of the photopolymerization initiator reaches a peak so that the ultraviolet light is not blocked by the pigment at the top layer side of the layered ink.

There are times where descending order of the ultraviolet absorption intensities of the pigments of the aqueous UV inks is equivalent to descending order of the densities of the pigments of the aqueous UV inks and times where, depending on the case, it is not equivalent. That is, there are also cases where descending order of the densities of the pigments of the aqueous UV inks does not coincide with descending order of the light blocking effects of the aqueous UV inks However, in the present embodiment, the plural inkjet heads may also jet the aqueous UV inks in descending order of the densities of the pigments of the UV inks on the premise that the plural inkjet heads jet the aqueous UV inks in descending order of the light blocking effects of the aqueous UV inks.

—Control System—

Figure 3:
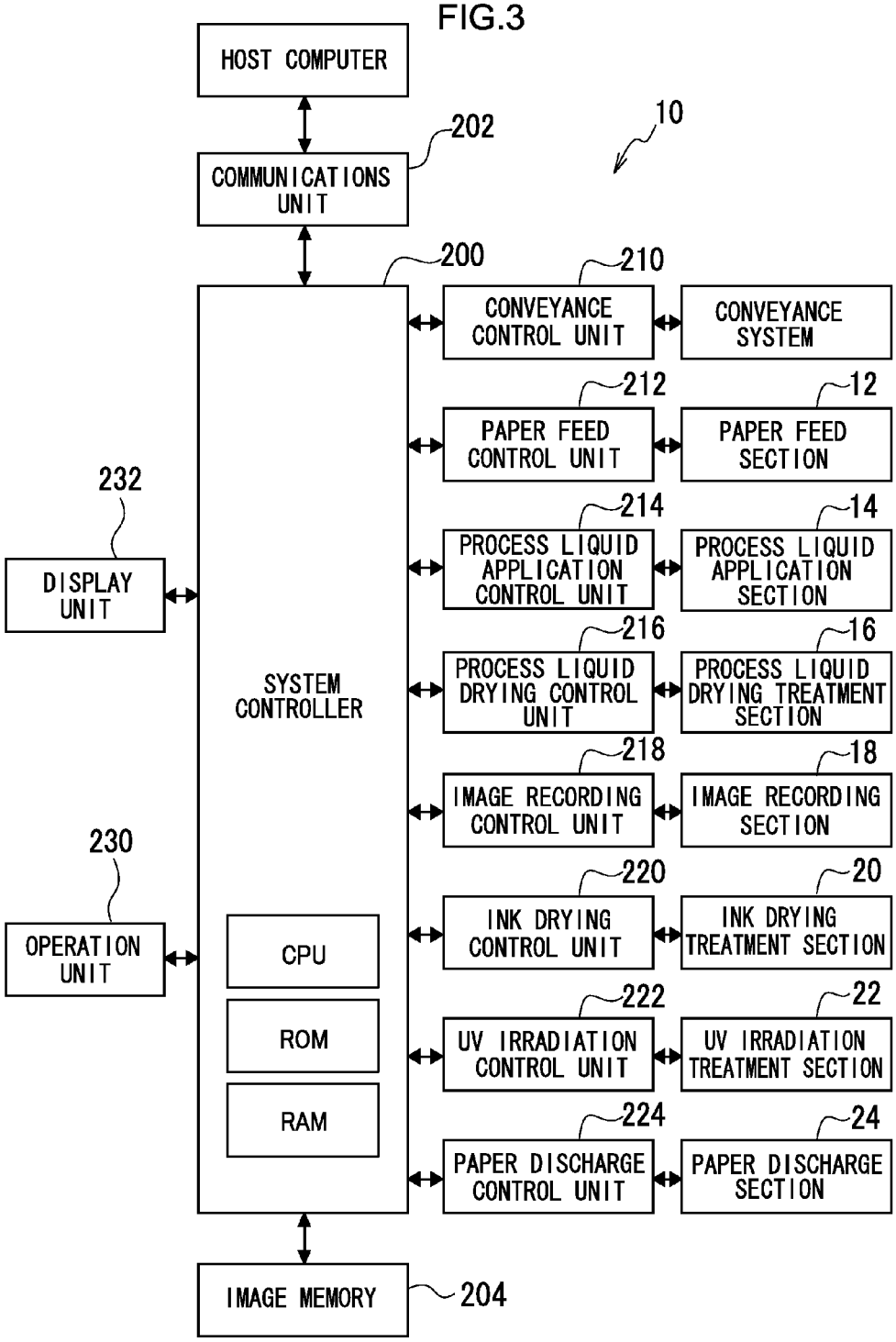
FIG. 3 is a block diagram showing the schematic configuration of a control system of the inkjet recording apparatus pertaining to the embodiment of the present invention.

FIG. 3 is a block diagram showing the schematic configuration of a control system of the inkjet recording apparatus 10 pertaining to the embodiment of the present invention.

As shown in FIG. 3, the inkjet recording apparatus 10 is equipped with a system controller 200, a communication unit 202, an image memory 204, a conveyance control unit 210, a paper feed control unit 212, a process liquid application control unit 214, a process liquid drying control unit 216, an image recording control unit 218, an ink drying control unit 220, a UV irradiation control unit 222, a paper discharge control unit 224, an operation unit 230, a display unit 232, and so forth.

The system controller 200 functions as a control unit that exercises integrated control over each section of the inkjet recording apparatus 10 and functions as an arithmetic unit that performs various types of arithmetic processing. The system controller 200 is equipped with a CPU, a ROM, a RAM, and so forth and operates in accordance with a predetermined control program. The control program that the system controller 200 executes and various types of data needed for control are stored in the ROM.

The communication unit 202 is equipped with a required communication interface and transmits data to and receives data from a host computer connected to the communication interface.

The image memory 204 functions as a temporary storage unit for temporarily storing various types of data including image data. Data are read from and written to the image memory 204 through the system controller 200. Image data that have been imported from the host computer via the communication unit 202 are stored in the image memory 204.

The conveyance control unit 210 controls the conveyance system such as the chain gripper 64. That is, the conveyance control unit 210 controls the driving of the tape feeders 36A, the feed guide 38, and the paper feed drum 40 in the paper feed section 12 and controls the driving of the process liquid application drum 42 in the process liquid application section 14, the driving of the process liquid drying treatment drum 46 in the process liquid drying treatment section 16, and the driving of the image recording drum 52 in the image recording section 18. Further, the conveyance control unit 210 controls the driving of the chain gripper 64 and the back tension application mechanism 66 used in common by the ink drying treatment section 20, the UV irradiation treatment section 22, and the paper discharge section 24.

The conveyance control unit 210 controls the conveyance system in accordance with a command from the system controller 200 in such a way that the paper sheet P is conveyed smoothly from the paper feed section 12 to the paper discharge section 24.

The paper feed control unit 212 controls the paper feed section 12 in accordance with a command from the system controller 200. Specifically, the paper feed control unit 212 controls the driving of the sucker device 32 and the paper feed tray raising-and-lowering mechanism in such a way that the paper sheets P stacked in the paper feed tray 30 are sequentially supplied one sheet at a time without overlap.

The process liquid application control unit 214 controls the process liquid application section 14 in accordance with a command from the system controller 200. Specifically, the process liquid application control unit 214 controls the driving of the process liquid application unit 44 in such a way that the process liquid is applied to the paper sheet P conveyed by the process liquid application drum 42.

The process liquid drying control unit 216 controls the process liquid drying treatment section 16 in accordance with a command from the system controller 200. Specifically, the process liquid drying control unit 216 controls the driving of the process liquid drying treatment unit 50 in such a way that the paper sheet P conveyed by the process liquid drying treatment drum 46 is administered the drying treatment.

The image recording control unit 218 controls the image recording section 18 in accordance with a command from the system controller 200. Specifically, the image recording control unit 218 controls the driving of the inkjet heads 56M, 56K, 56C, and 56Y in such a way that a predetermined image is recorded on the paper sheet P conveyed by the image recording drum 52. The image recording control unit 218 controls the driving (controls the jetting) of the inkjet heads 56M, 56K, 56C, and 56Y from the upstream side when layer-jetting the plural aqueous UV inks For this reason, the aqueous UV inks are jetted in order (in the order of 56M, 56K, 56C, and 56Y) beginning with the inkjet head that jets the ultraviolet-curable color ink having the largest ultraviolet blocking effect among the plural aqueous UV inks that the inkjet heads layer-jet.

Further, the image recording control unit 218 controls the operation of the inline sensor 58 in such a way that the recorded image is read.

The ink drying control unit 220 controls the ink drying treatment section 20 in accordance with a command from the system controller 200. Specifically, the ink drying control unit 220 controls the driving of the ink drying treatment units 68 in such a way that hot air is blown onto the paper sheet P conveyed by the chain gripper 64.

The UV irradiation control unit 222 controls the UV irradiation treatment section 22 in accordance with a command from the system controller 200. Specifically, the UV irradiation control unit 222 controls the driving of the UV irradiation units 74 in such a way that ultraviolet light is applied to the paper sheet P conveyed by the chain gripper 64.

The paper discharge control unit 224 controls the paper discharge section 24 in accordance with a command from the system controller 200. Specifically, the paper discharge control unit 224 controls the driving of the paper discharge tray raising-and-lowering mechanism and so forth in such a way that the paper sheets P are stacked in the paper discharge tray 76.

The operation unit 230 is equipped with required operation components (e.g., operation buttons, a keyboard, a touch panel, etc.) and outputs to the system controller 200 operation information that has been inputted from the operation components. The system controller 200 executes various types of processing in accordance with the operation information that has been inputted from the operation unit 230.

The display unit 232 is equipped with a required display device (e.g., an LCD panel or the like) and causes required information to be displayed on the display device in accordance with a command from the system controller 200.

As described above, image data to be recorded on the paper sheets P is imported to the inkjet recording apparatus 10 via the communication unit 202 from the host computer. The imported image data are stored in the image memory 204.

The system controller 200 administers required signal processing to the image data stored in the image memory 204 to thereby generate dot data. Then, the system controller 200 controls the driving of the inkjet heads 56M, 56K, 56C, and 56Y of the image recording section 18 in accordance with the generated dot data and records on the paper sheets P the image represented by the image data.

The dot data are generated generally by performing color conversion processing and halftone processing with respect to the image data. Color conversion processing is processing that converts image data expressed by sRGB or the like (e.g., RGB 8-bit image data) into ink quantity data of each color of ink used by the inkjet recording apparatus 10 (in the present example, the image data are converted into ink quantity data of each of the colors of C, M, Y, and K). Halftone processing is processing that converts the ink quantity data of each color generated by the color conversion processing into dot data of each color by processing such as error diffusion.

The system controller 200 performs color conversion processing and halftone processing with respect to the image data to thereby generate dot data of each color. Then, the system controller 200 controls the driving of the corresponding inkjet heads in accordance with the generated dot data of each color to thereby record on the paper sheets P the image represented by the image data.

—Action and Effects—

Next, in order to clarify the action and effects of the inkjet recording apparatus 10 pertaining to the present embodiment, a case where ultraviolet light is applied to layered ink of reference examples will be described.

Figure 8A:
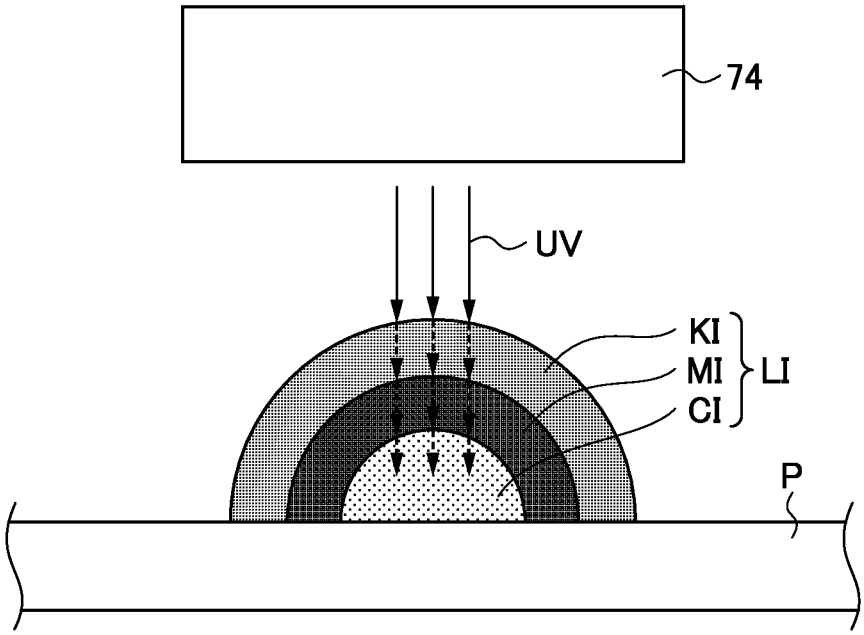
FIG. 8A and FIG. 8B are diagrams showing ultraviolet light being applied to layered ink of reference examples.
Figure 8B:
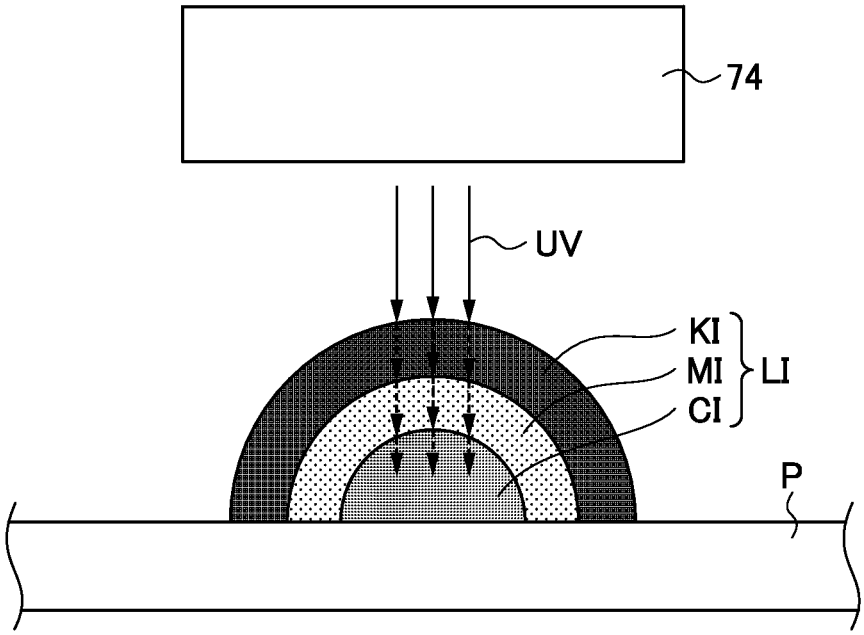

FIG. 8A and FIG. 8B are diagrams showing ultraviolet light being applied to layered ink LI of reference examples.

In FIG. 8A, a layer of magenta aqueous UV ink MI having the largest ultraviolet blocking effect is in the middle layer of the layered ink LI, so the layers of the aqueous UV inks are not positioned in descending order of ultraviolet blocking effect from the deepest layer side. Similarly, in FIG. 8B, the layer of magenta aqueous UV ink MI having the largest ultraviolet blocking effect is in the topmost layer of the layered ink LI, so the layers of the aqueous UV inks are not positioned in descending order of ultraviolet blocking effect from the deepest layer side.

Additionally, when the ultraviolet light applied by the UV irradiation unit 74 strikes the layered ink LI of the reference examples shown in FIG. 8A and FIG. 8B, the ultraviolet light becomes blocked at the top layer side of the layered ink LI and the amount of ultraviolet light passing through to the middle of the layered ink LI ends up decreasing because an ink layer having a large ultraviolet blocking effect (e.g., the magenta aqueous UV ink MI) is positioned on the top layer side of the layered ink LI. As a result, curing does not proceed to the middle of the layered ink LI, and the film strength of the layered ink LI ends up becoming lower.

Next, the action and effects of the inkjet recording apparatus 10 pertaining to the present embodiment will be described.

Figure 4A:
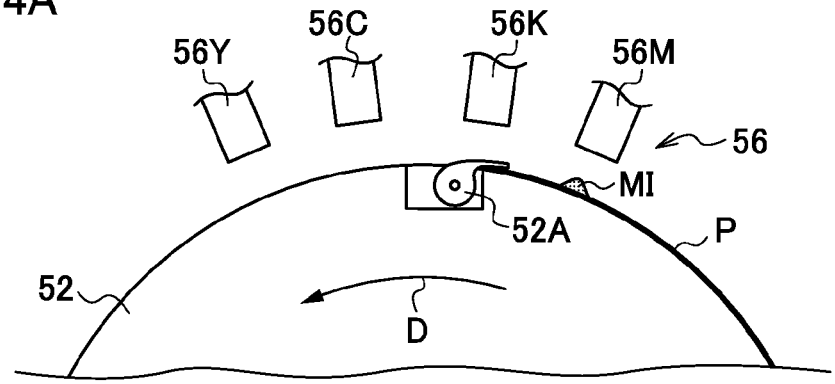
FIG. 4A to FIG. 4C are diagrams showing the aqueous UV inks being layer-jetted in the inkjet recording apparatus pertaining to the embodiment.
Figure 4B:
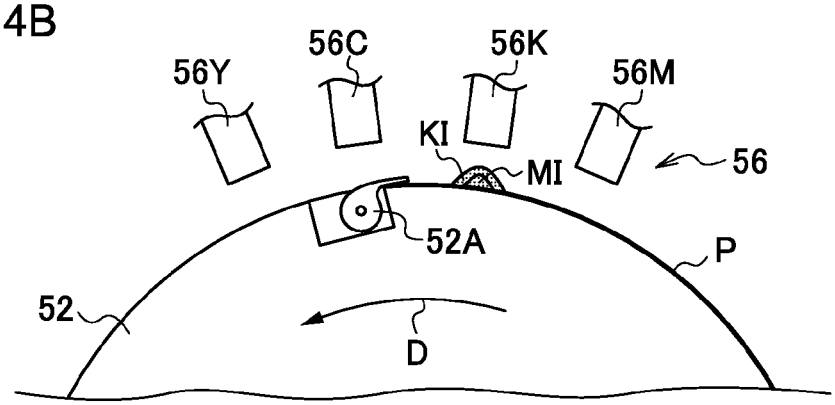
Figure 4C:
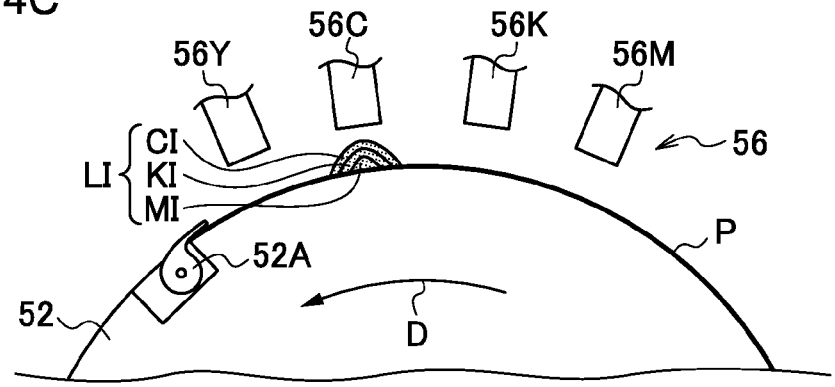
Figure 5A:
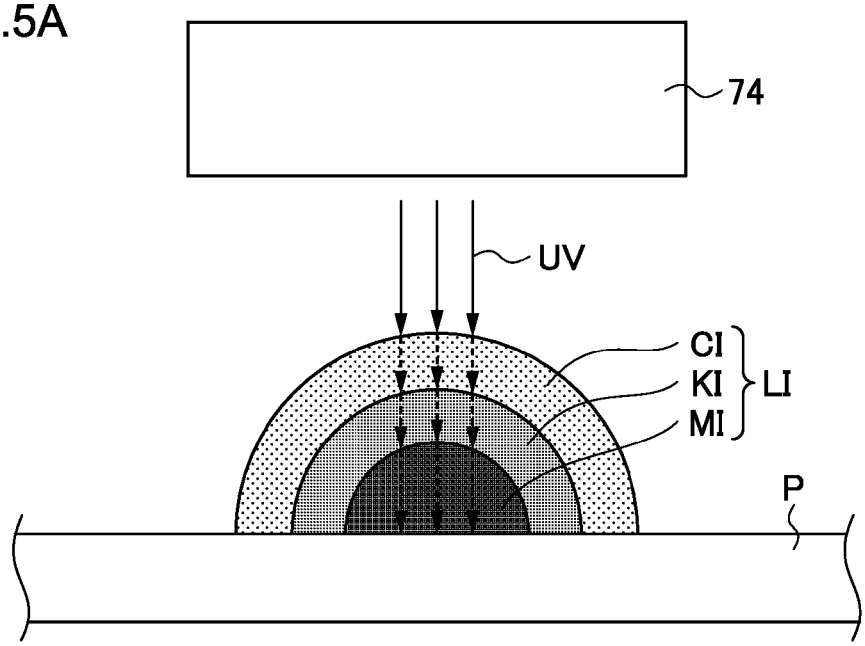
FIG. 5A is a diagram showing ultraviolet light being applied to layered ink that has been layer-jetted in the inkjet recording apparatus pertaining to the embodiment.

FIG. 4A to FIG. 4C are diagrams showing aqueous UV inks being layer-jetted in the inkjet recording apparatus 10 pertaining to the present embodiment. In order to make it easier to understand the action of the present embodiment, FIG. 4A to FIG. 4C show a case where the aqueous UV inks are jetted one droplet at a time in the conveyance direction D from each head, but the same action and effects as those described below also exist in a case where the aqueous UV inks are jetted in plural droplets in the conveyance direction D. FIG. 5A is a diagram showing ultraviolet light being applied to layered ink LI that has been layer-jetted in the inkjet recording apparatus 10 pertaining to the present embodiment.

According to the inkjet recording apparatus 10 pertaining to the present embodiment, the plural inkjet recording heads 56M, 56K, 56C, and 56Y have a configuration where, when the plural inkjet recording heads 56M, 56K, 56C, and 56Y layer-jet different types of aqueous UV inks, the plural inkjet recording heads 56M, 56K, 56C, and 56Y jet the plural aqueous UV inks in descending order of ultraviolet blocking effect.

Specifically, let us suppose a case where the plural inkjet heads 56M, 56K, 56C, and 56Y layer-jet the magenta, black, and cyan aqueous UV inks among the magenta, black, yellow, and cyan aqueous UV inks onto the paper sheet P conveyed by the image recording drum 52.

According to the inkjet recording apparatus 10 pertaining to the present embodiment, first, as shown in FIG. 4A, when the paper sheet P passes directly under the inkjet head 56M disposed on the most upstream side in the conveyance direction D of the paper sheet P, the inkjet head 56M first jets onto the passing paper sheet P the magenta aqueous UV ink MI having the largest ultraviolet blocking effect among the aqueous UV inks that the inkjet heads layer-jet.

Next, as shown in FIG. 4B, when the paper sheet P passes directly under the inkjet head 56K disposed on the downstream side of the inkjet head 56M in the conveyance direction D of the paper sheet P, the inkjet head 56K jets the black aqueous UV ink KI having the second largest ultraviolet blocking effect among the aqueous UV inks that the inkjet heads layer-jet, in such a way that the black aqueous UV ink KI becomes layered on the magenta aqueous UV ink MI on the passing paper sheet P.

Finally, as shown in FIG. 4C, when the paper sheet P passes directly under the inkjet head 56C disposed on the downstream side of the inkjet head 56K in the conveyance direction D of the paper sheet P, the inkjet head 56C jets the cyan aqueous UV ink CI having the third largest ultraviolet blocking effect among the aqueous UV inks that the inkjet heads layer-jet, in such a way that the cyan aqueous UV ink CI becomes layered on the black aqueous UV ink KI on the passing paper sheet P.

Because of this, as shown in FIG. 4C and FIG. 5A, layered ink LI, in which the plural types of aqueous UV inks are layered in the thickness direction of the paper sheet P, is formed on the front surface (recording surface) of the paper sheet P. In the layered ink LI, the ink layers are positioned in descending order of ultraviolet blocking effect from the deepest layer heading toward the topmost layer. That is, the ink layer of the magenta aqueous UV ink MI, the ink layer of the black aqueous UV ink KI, and the ink layer of the cyan aqueous UV ink CI are positioned in order from the deepest layer of the layered ink LI.

Next, after the layered ink LI has been formed, the paper sheet P is conveyed directly under the UV irradiation units 74, and the ultraviolet light applied from the UV irradiation units 74 strikes the layered ink LI on the paper sheet P.

When the ultraviolet light strikes the layered ink LI, the ultraviolet light passes through from the top layer side to the deep layer side of the layered ink LI—that is, the light passes through in order beginning with the ink layer having the small ultraviolet blocking effect (in the order of the ink layer of the cyan aqueous UV ink, the ink layer of the black aqueous UV ink, and the ink layer of the magenta aqueous UV ink). Because of this, the ultraviolet light can be kept from being blocked at the top layer side of the layered ink LI, and the amount of ultraviolet light passing through to the deep layer side of the layered ink LI can be increased. As a result, ultraviolet curing proceeds to the ink layers on the deep layer side of the layered ink LI, and the film strength of the layered ink LI becomes higher compared to that of the layered ink LI of the reference examples shown in FIG. 8A and FIG. 8B.

More specifically, in a case where the plural types of aqueous UV inks include a common photopolymerization initiator and different types of pigments, in the present embodiment, the plural inkjet heads 56M, 56K, 56C, and 56Y can also be given a configuration where, when the plural inkjet heads 56M, 56K, 56C, and 56Y layer-jet the aqueous UV inks, the plural inkjet heads 56M, 56K, 56C, and 56Y jet the aqueous UV inks in order in descending order of the ultraviolet absorption intensities of the pigments in the ultraviolet wavelength (range) W1 in which the ultraviolet absorption intensity of the common photopolymerization initiator reaches a peak.

According to this configuration, as shown in FIG. 5A, the ink layers become positioned in descending order of the ultraviolet absorption intensities of the pigments, from the deepest layer to the topmost layer of the layered ink LI, in the ultraviolet wavelength (range) W1 in which the ultraviolet absorption intensity of the common photopolymerization initiator reaches a peak.

Additionally, when the ultraviolet light applied from the UV irradiation units 74 strikes the layered ink L1, ultraviolet light in the wavelength (range) W1 needed for radical generation by the photopolymerization initiator can be kept from being blocked at the top layer side of the layered ink LI, and the amount of ultraviolet light passing through to the deep layer side of the layered ink LI can be increased. As a result, photocuring proceeds to the ink layers on the deep layer side of the layered ink LI, and the film strength of the layered ink LI becomes higher.

—Example Modifications—

The present invention has been described in detail in regard to a particular embodiment, but the present invention is not limited to this embodiment. It will be apparent to persons skilled in the art that a variety of other embodiments are possible in the scope of the present invention. For example, the plural embodiments described above can be appropriately combined and implemented. Further, the example modifications described below may also be appropriately combined.

For example, in the above-described embodiment, a case was described where, when the plural inkjet heads 56M, 56K, 56C, and 56Y layer-jet the different types of aqueous UV inks, the plural inkjet heads 56M, 56K, 56C, and 56Y jet the plural aqueous UV inks in descending order of ultraviolet blocking effect. For example, the plural inkjet heads 56M, 56K, 56C, and 56Y may also have a configuration where, when the plural inkjet heads 56M, 56K, 56C, and 56Y layer-jet the different types of aqueous UV inks, the plural inkjet heads 56M, 56K, 56C, and 56Y first jet the aqueous UV ink having the largest ultraviolet blocking effect among the plural aqueous UV inks that the plural inkjet heads 56M, 56K, 56C, and 56Y layer-jet and the order in which the remaining aqueous UV inks are jetted is not descending order of ultraviolet blocking effect.

Specifically, the inkjet recording apparatus may include: a first jetting head which, when different types of photocurable color inks are to be plurally layered, first jets the photocurable color ink having the largest light blocking effect among the plural photocurable color inks onto a conveyed recording medium; a second jetting head that jets the photocurable color ink having a smaller light blocking effect than that of the photocurable color ink having the largest light blocking effect in such a way that the photocurable color ink having the smaller light blocking effect becomes layered on the photocurable color ink having the largest light blocking effect that has been jetted from the first jetting head; and an irradiation device that applies light to the photocurable color inks that have been jetted onto the recording medium.

Figure 5B:
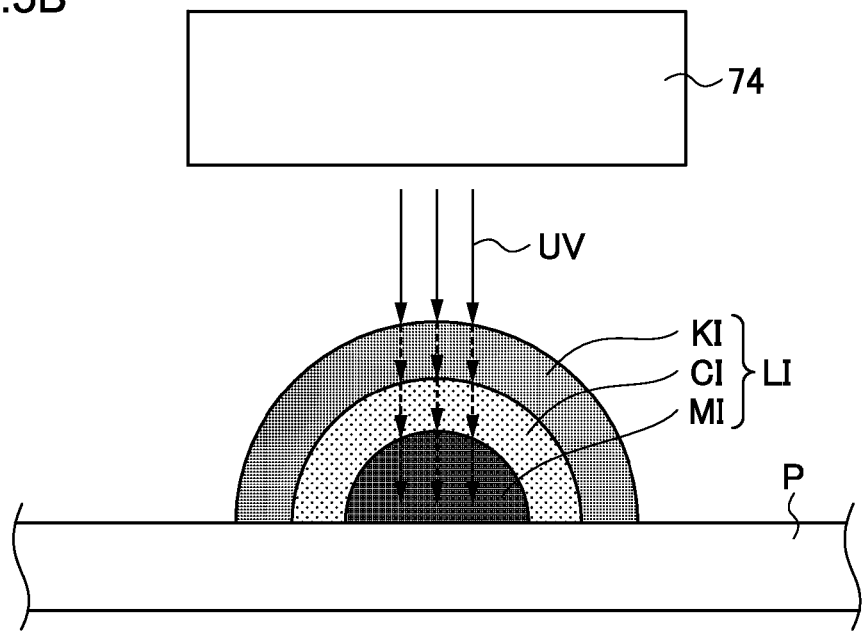
FIG. 5B is a diagram showing ultraviolet light being applied to layered ink in which the top layer side is not in descending order of ultraviolet blocking effect.

Although it will be described in working examples below, this is because even when, as shown in FIG. 5B, the top layer side of the layered ink LI is not in descending order of ultraviolet blocking effect—that is, in contrast to FIG. 5A, even when the cyan aqueous UV ink CI is in a lower layer than the black aqueous UV ink KI—the film strength of the layered ink LI becomes sufficiently higher if the magenta aqueous UV ink MI having the largest ultraviolet blocking effect is positioned in the deepest layer of the layered ink LI.

Specifically, when the plural inkjet heads 56M, 56K, 56C, and 56Y first jet the aqueous UV ink having the largest effect of blocking the ultraviolet light applied by the UV irradiation units 74, the ink layer having the largest ultraviolet blocking effect becomes positioned in the deepest layer of the layered ink LI in which the plural types of aqueous UV inks are layered in the thickness direction of the paper sheet P. Additionally, when the ultraviolet light applied from the UV irradiation units 74 strikes the layered ink LI, the ultraviolet light passes through from the top layer side to the deep layer side of the layered ink LI and finally passes through the ink layer having the largest ultraviolet blocking effect that is positioned in the deepest layer. Because of this, the ultraviolet light does not pass through the ink layer having the largest ultraviolet blocking effect until the ultraviolet light passes through to the deepest layer of the layered ink LI, so the ultraviolet light can be kept from being blocked at the top layer side of the layered ink LI, and the amount of ultraviolet light passing through particularly to the deepest layer of the deep layer side of the layered ink LI can be increased. As a result, photocuring proceeds to the ink layers on the deep layer side of the layered ink LI, and the film strength of the layered ink LI becomes higher.

For the same reason as described above, the plural inkjet heads 56M, 56K, 56C, and 56Y may also have a configuration where they first jet the aqueous UV ink whose pigment has the largest ultraviolet absorption intensity in the ultraviolet wavelength range in which the ultraviolet absorption intensity of the common photopolymerization initiator reaches a peak.

Further, in the above-described embodiment, a case was described where the inkjet recording apparatus 10 is equipped with the plural inkjet heads 56M, 56K, 56C, and 56Y, but the inkjet recording apparatus 10 may also be equipped with a single inkjet head that jets plural types of aqueous UV inks.

Further, a case was described where ultraviolet light is applied to the layered ink LI, but light in other wavelength ranges such as infrared may also be applied.

Further, in the above-described embodiment, the MKYC standard color (four-color) configuration was exemplified, but the combination of the ink colors and the number of colors is not limited to the present embodiment. Light inks, dark inks, and special color inks may also be added as needed. For example, a configuration that adds inkjet heads that jet light inks such as light cyan and light magenta is also possible.

Further, in the above-described embodiment, a case was described where the inkjet heads 56M, 56K, 56C, and 56Y are placed in such a way as to jet the aqueous UV inks in descending order of ultraviolet blocking effect, but the placement order of the heads is not particularly limited as long as the heads can jet the aqueous UV inks in descending order of ultraviolet blocking effect. However, by placing the heads in such a way as to jet the aqueous UV inks in descending order of ultraviolet blocking effect, control such as described below is not necessary, so the control of the inkjet heads 56M, 56K, 56C, and 56Y can be simplified.

In a case where the inkjet heads are not placed in such a way as to jet the aqueous UV inks in descending order of ultraviolet blocking effect, for example, the image recording control unit 218 may be configured to control the image recording section 18 to rearrange the inkjet heads so that the inkjet heads jet the aqueous UV inks in descending order of ultraviolet blocking effect before printing on the paper sheet P.

Specifically, in order to rearrange the order of the inkjet heads 56C, 56M, 56Y, and 56K in the order of the inkjet heads 56M, 56K, 56C, and 56Y, the image recording control unit 218 controls an unillustrated drive mechanism disposed in the image recording section 18 to move the inkjet heads.

Figure 6A:
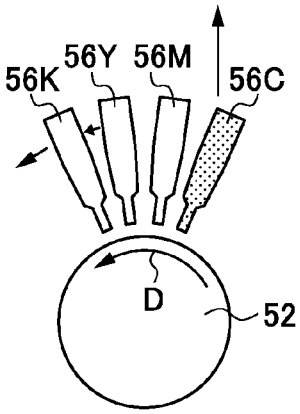
FIG. 6A to FIG. 6E are diagrams showing an example modification of the inkjet recording apparatus pertaining to the embodiment of the present invention and sequentially show the placement of inkjet heads being rearranged.

First, as shown in FIG. 6A, the image recording control unit 218 moves the inkjet head 56C upward. Further, in order to ensure some space between the inkjet head 56M and the inkjet head 56Y, the image recording control unit 218 moves the inkjet heads 56K and 56Y downstream in the conveyance direction D.

Figure 6D:
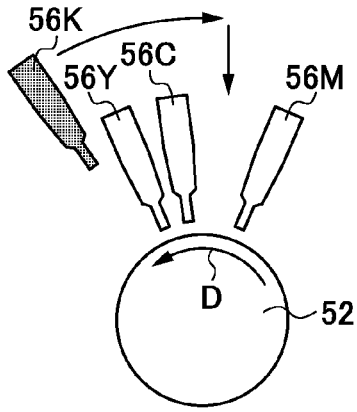
Figure 6B:
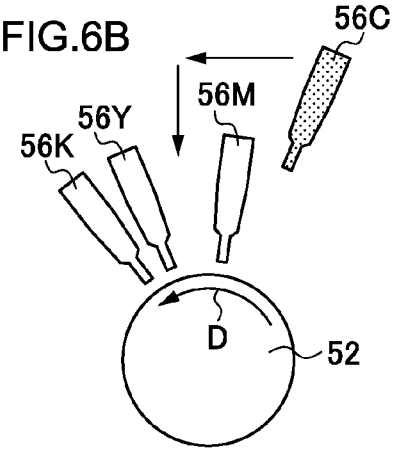

Next, as shown in FIG. 6B, the image recording control unit 218 moves the inkjet head 56C downstream in the conveyance direction D above the image recording drum 52 and then moves the inkjet head 56C downward in such a way that the inkjet head 56C enters the space between the inkjet head 56M and the inkjet head 56Y.

Figure 6E:
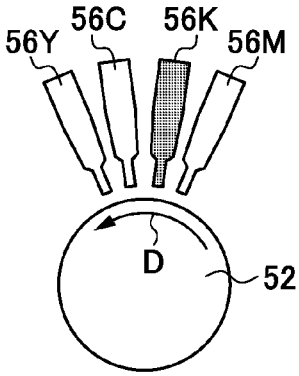
Figure 6C:
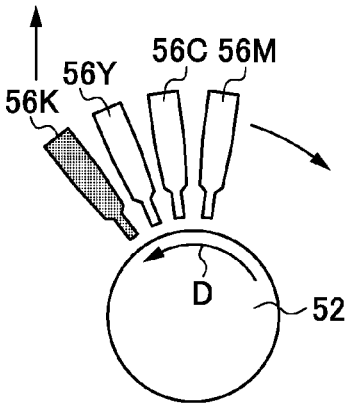

Moreover, as shown in FIG. 6C, the image recording control unit 218 moves the inkjet head 56K upward. Further, in order to ensure some space between the inkjet head 56M and the inkjet head 56C, the image recording control unit 218 moves the inkjet head 56M upstream in the conveyance direction D.

Finally, as shown in FIG. 6D and FIG. 6E, the image recording control unit 218 moves the inkjet head 56K upstream in the conveyance direction D above the image recording drum 52 and then moves the inkjet head 56K downward in such a way that the inkjet head 56K enters the space between the inkjet head 56M and the inkjet head 56C.

As described above, the inkjet heads become placed in the order of the inkjet head 56M, the inkjet head 56K, the inkjet head 56C, and the inkjet head 56Y, and the inkjet heads become rearranged in such a way that the inkjet heads jet the aqueous UV inks in descending order of ultraviolet blocking effect.

In a case where the inkjet heads are not placed in such a way that the inkjet heads jet the aqueous UV inks in descending order of ultraviolet blocking effect, the conveyance control unit 210 may be configured to control the image recording drum 52 to alternate between rotating in the conveyance direction D and rotating in the opposite direction so that the paper sheet P is moved as needed under the inkjet heads from which the aqueous UV inks are layer-jetted and so that the aqueous UV inks are layer-jetted in descending order of ultraviolet blocking effect. In this case, changing to belt conveyance or the like is preferred because it becomes difficult to control the rotation of the image recording drum 52.

Further, a case was described where the UV irradiation control unit 222 has the function of controlling the driving of the UV irradiation units 74 in such a way that ultraviolet light is applied to the paper sheet P, but in addition to this, the UV irradiation control unit 222 may also be configured to have a function as an adjustment unit which, when the aqueous UV inks are to be layer-jetted, adjusts the peak illuminance value of the UV lamps in the UV irradiation units 74 or the integrated amount of irradiation in accordance with the combination of the aqueous UV inks.

The UV irradiation control unit 222 serving as the adjustment unit can keep the film strength of the layered ink LI constant even when the combination of the aqueous UV inks changes by performing an adjustment that raises the peak illuminance value of the UV lamps of the UV irradiation units 74 or increases the integrated amount of irradiation in a case where, depending on the combination of the aqueous UV inks, for example, the film strength of the layered ink LI will not become the required film strength. More specifically, there are cases where it is difficult for the layered ink LI to be cured if magenta is included in the combination of aqueous UV inks, so the UV irradiation control unit 222 raises the peak illuminance value of the UV lamps or increases the integrated amount of irradiation compared to when magenta is not included. In addition, it is difficult for the layered ink LI to be cured if magenta is included in a large quantity in the combination of aqueous UV inks, so the UV irradiation control unit 222 raises the peak illuminance value of the UV lamps even more or increases the integrated amount of irradiation even more.

Figure 7A:
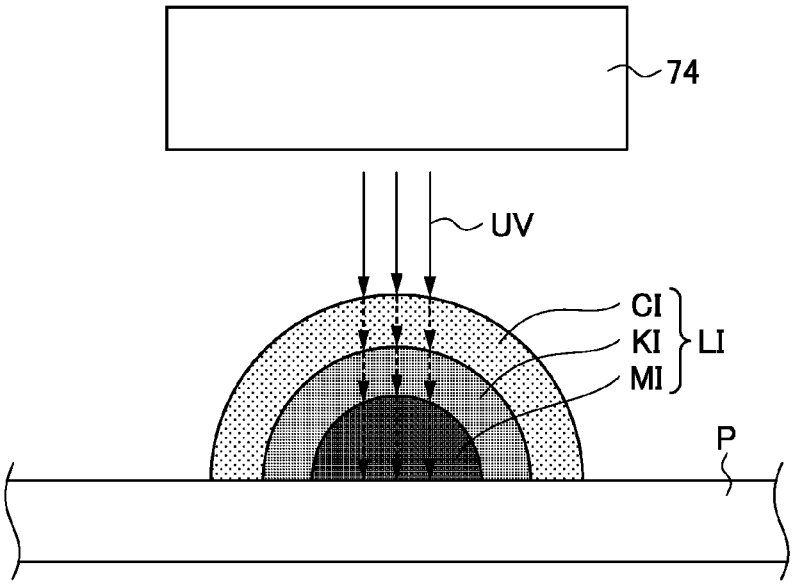
FIG. 7A is a diagram showing an initial position of a UV irradiation unit.
Figure 7B:
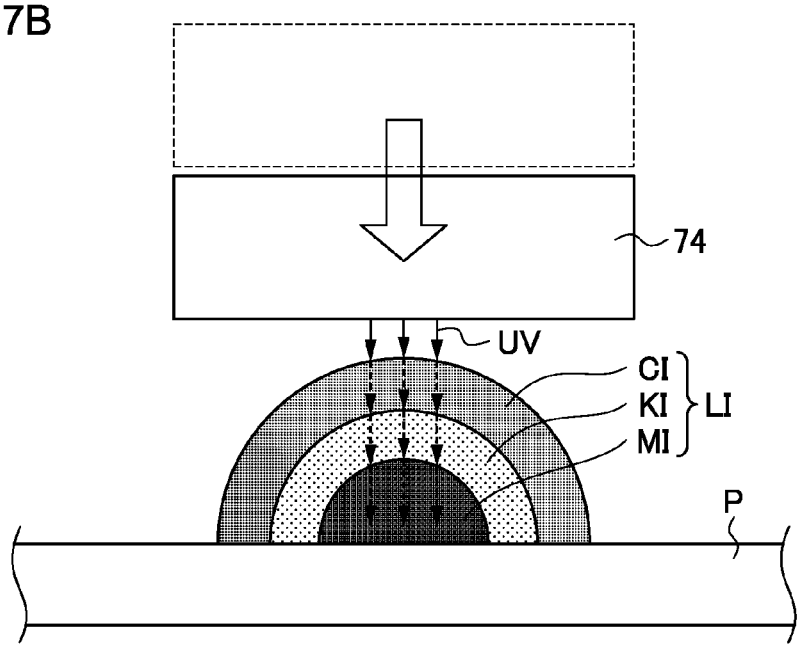
FIG. 7B is a diagram showing a position after the UV irradiation unit has moved toward a recording medium.

Adjusting the peak illuminance value can be realized by the UV irradiation control unit 222 varying the output of the UV lamps or varying the distance between the UV lamps and the conveyed paper sheet P. For example, in order to raise the peak illuminance value, it suffices for the UV irradiation control unit 222 to raise the output of the UV lamps or shorten the distance between the UV lamps and the conveyed paper sheet P as shown in FIG. 7A and FIG. 7B.

Further, adjusting the integrated amount of irradiation can be realized by the UV irradiation control unit 222 giving an instruction to the conveyance control unit 210 via the system controller 200 to vary the speed at which the paper sheet P is conveyed by the chain gripper 64. For example, increasing the integrated amount of irradiation can be realized by the UV irradiation control unit 222 giving an order to the conveyance control unit 210 to slow down the speed at which the paper sheet P is conveyed by the chain gripper 64.

EXAMPLES

Examples will be described below, but the present invention is in no way limited to these working examples. Unless otherwise noted, "percent" and "part(s)" are on a mass basis.

(Preparation of Polymer Dispersant 1 Solution)

A mixed solution was prepared by adding 6 parts styrene, 11 parts stearyl methacrylate, 4 parts styrene macromer AS-6 (made by Toagosei Co., Ltd.), 5 parts BLEMMER PP-500 (made by NOH Corporation), 5 parts methacrylic acid, 0.05 parts 2-mercaptoethanol, and 24 parts methyl ethyl ketone to a reaction container.

Meanwhile, a mixed solution was prepared by adding 14 parts styrene, 24 parts stearyl methacrylate, 9 parts styrene macromer AS-6 (made by Toagosei Co., Ltd.), 9 parts BLEMMER PP-500 (made by NOH Corporation), 10 parts methacrylic acid, 0.13 parts 2-mercaptoethanol, 56 parts methyl ethyl ketone, and 1.2 parts 2,2'-Azobis(2,4-dimethylvaleronitrile) to a dropping funnel.

Then, the temperature was raised to 75° C. while the mixed solution in the reaction container was agitated under a nitrogen atmosphere, and the mixed solution in the dropping funnel was gradually dropped over 1 hour. 2 hours after the dropping ended, a solution in which 1.2 parts 2,2'-Azobis(2,4-dimethylvaleronitrile) was dissolved in 12 parts methyl ethyl ketone was dropped into this over 3 hours and allowed to mature for 2 hours at 75° C. and 2 hours at 80° C. to obtain a polymer dispersant 1 solution.

Some of the obtained polymer dispersant 1 solution was isolated by removing the solvent, the obtained solid content was diluted to 0.1 mass percent with tetrahydrofuran, and the weight average molecular weight was measured by high-speed gel permeation chromatography (GPC) using the HLC-8220 GPC (made by Tosoh Corporation) by connecting TSKgel Super HZM-H, TSKgel Super HZ4000, and TSKgel Super HZ2000 (made by Tosoh Corporation) in a 3-column series. As a result, the weight average molecular weight was 25,000 in polystyrene conversion. Further, when the acid value of the polymer was found by the method described in JIS standards (JIS K0070:1992), it was 99 mg KOH/g.

(Preparation of Pigment Dispersion Solution M)

5.0 g in solid content conversion of the obtained polymer dispersant 1 solution, 10.0 g of Chromophthal Jet Magenta DMQ (pigment red 122, made by BASF Japan Ltd.), 40.0 g of methyl ethyl ketone, 8.0 g of 1 mol/L (liter; same below) sodium hydroxide, and 82.0 of ion exchange water were supplied to a vessel together with 300 g of 0.1 mm zirconia beads and were dispersed for 6 hours at 1000 rpm using a ready mill disperser (made by AIMEX Corporation). The obtained dispersion solution was vacuum concentrated until the methyl ethyl ketone could be sufficiently distilled off in an evaporator and was then further concentrated until the pigment concentration became 10% to prepare a pigment dispersion solution M in which the water-dispersible pigment was dispersed.

(Preparation of Pigment Dispersion Solution K)

5.0 g in solid content conversion of the obtained polymer dispersant 1 solution, 10.0 g of carbon black (MA-100 made by Mitsubishi Chemical Corporation), 40.0 g of methyl ethyl ketone, 8.0 g of 1 mol/L (liter; same below) sodium hydroxide, and 82.0 of ion exchange water were supplied to a vessel together with 300 g of 0.1 mm zirconia beads and were dispersed for 6 hours at 1000 rpm using a ready mill disperser (made by AIMEX Corporation). The obtained dispersion solution was vacuum concentrated until the methyl ethyl ketone could be sufficiently distilled off in an evaporator and was then further concentrated until the pigment concentration became 10% to prepare a pigment dispersion solution K in which the water-dispersible pigment was dispersed.

(Preparation of Pigment Dispersion Solution C)

5.0 g in solid content conversion of the obtained polymer dispersant 1 solution, 10.0 g of Pigment Blue 15:3 (made by Dainichiseika Color & Chemicals Mfg. Co., Ltd.), 40.0 g of methyl ethyl ketone, 8.0 g of 1 mol/L (liter; same below) sodium hydroxide, and 82.0 of ion exchange water were supplied to a vessel together with 300 g of 0.1 mm zirconia beads and were dispersed for 6 hours at 1000 rpm using a ready mill disperser (made by AIMEX Corporation). The obtained dispersion solution was vacuum concentrated until the methyl ethyl ketone could be sufficiently distilled off in an evaporator and was then further concentrated until the pigment concentration became 10% to prepare a pigment dispersion solution C in which the water-dispersible pigment was dispersed.

(Synthesis of Polymerizable Monomer (B-1))

(First Step)

121 g (1 equivalent) of tris(hydroxymethyl)aminomethane (made by Tokyo Chemical Industry Co., Ltd.), 84 ml of 50% potassium hydroxide aqueous solution, and 423 ml of toluene were added to a 1-L capacity three-necked round-bottom flask equipped with a stir bar and agitated, the reaction system was maintained at 20 to 25° C. under a water bath, and 397.5 g (7.5 equivalent) of acrylonitrile was dropped over 2 hours. After agitating for 1.5 hours after the dropping, 540 ml of toluene was added to the reaction system, the reaction mixture was moved to a separating funnel, and the water layer was removed. The remaining organic layer was dried with magnesium sulfate, thereafter celite filtration was performed, and the solvent was distilled off under reduced pressure, whereby an acrylonitrile adduct was obtained. The result of analysis by $^{1}$H NMR, MS of the obtained substance showed a good match with known substances, so the substance was used in the next reduction reaction without further refinement.

(Second Step)

24 g of the acrylonitrile adduct that was obtained first, 48 g of a Ni catalyst (Raney nickel 2400, made by W. R. Grace & Co.), and 600 ml of a 1:1 solution of 25% ammonia water and methanol were put into a 1-L capacity autoclave and suspended, and the reaction container was closed. Hydrogen at 10 Mpa was introduced to the reaction container and allowed to react for 16 hours at a reaction temperature of 25° C.

The disappearance of material was configured by $^1$H NMR, the reaction mixture was celite filtered, and the celite was washed several times with methanol. The solvent was distilled off at reduced pressure from the filtrate, whereby a polyamine body was obtained. The obtained substance was used in the next reaction without further refinement.

(Third Step)

30 g of the polyamine body that was obtained first, 120 g (14 equivalent) of $NaHCO_3$, 1 L of dichloromethane, and 50 ml of water were added to a 2-L capacity three-necked round-bottom flask equipped with an agitator, 92.8 g (10 equivalent) of acryloyl chloride was dropped over 3 hours under an ice bath, and thereafter the mixture was agitated for 3 hours at room temperature. The disappearance of material was configured by $^1$H NMR, thereafter the solvent was distilled off at reduced pressure from the reaction mixture, the reaction mixture was dried with magnesium sulfate, celite filtration was performed, and the solvent was distilled off under reduced pressure. Finally, the mixture was refined by column chromatography (ethyl acetate/methanol=4:1), whereby a solid (yield 40%) of a polymerizable monomer (B-1) was obtained at normal temperature. The yield of the three steps was 40%.

(Manufacture of Aqueous UV Inks)

The components shown in Table 1 below were mixed and thereafter coarse particles were removed through a membrane filter (pore size of 5 μm) to prepare aqueous UV inks C1 to C3, K1 and K2, and M1 and M2. In Table 1, "-" means not contained. Further, the numerical values in Table 1 represent content by "mass percent". Further, the monofunctional polymerizable monomer in Table 1 is hydroxyethyl alkyl amide (made by KOHJIN Holdings Co., Ltd.). Further, the photopolymerization initiator in Table 1 is IRGACURE 2959 (made by BASF Japan Ltd.), and the surfactant is olefin E1010 (made by Nissin Chemical Co., Ltd.).

TABLE 1

| | | Aqueous UV Ink No. | | | | | | |
|---|---|---|---|---|---|---|---|---|
| | | C1 | C2 | C3 | K1 | M1 | K2 | M2 |
| Pigment | Magenta | — | — | — | — | 2 | — | 5 |
| | Black | — | — | — | 2 | — | 3.5 | — |
| | Cyan | 5 | 3 | 2 | — | — | — | — |
| Monofunctional Polymerizable Monomer | A-1 | | | | 10 | | | |
| Polyfunctional Polymerizable Monomer | B-1 | | | | 10 | | | |
| Photo-polymerization Initiator | | | | | 3 | | | |
| Surfactant | | | | | 1 | | | |
| Ion Exchange Water | | Residual amount by which total becomes 100% | | | | | | |

(Evaluation of Absorption Intensity)

Next, the ultraviolet absorption intensity of each pigment dispersion solution was evaluated in the ultraviolet wavelength range in which the ultraviolet absorption intensity of the photopolymerization initiator (IRGACURE 2959) reaches a peak.

In the evaluation, the ultraviolet absorption spectrums (absorption intensity with respect to each wavelength) of the pigment dispersion solutions of the aqueous UV inks C1 to C3, K1 and K2, and M1 and M2 and the photopolymerization initiator were measured with the ultraviolet-visible spectrophotometer V-570 (made by JASCO Corporation).

From the measured ultraviolet absorption spectrums, it was understood that the ultraviolet wavelength (range) in which the ultraviolet absorption intensity of the photopolymerization initiator of the aqueous UV inks used in the present experiment reaches a peak was 280 mm.

Additionally, from the measured ultraviolet absorption spectrums, the ranks of the absorption intensities (=ultraviolet blocking) of the pigment dispersion solutions of the aqueous UV inks C1 to C3, K1 and K2, and M1 and M2 in the wavelength of 280 nm were found. The ranks of the absorption intensities of the pigment dispersion solutions are put together in Table 2 below.

TABLE 2

| Aqueous UV Ink | Pigment Concentration [mass percent] | Rank of UV Blocking |
|---|---|---|
| M2 | 5 | (1) |
| M1 | 2 | (3) |
| K2 | 3.5 | (2) |
| K1 | 2 | (5) |
| C1 | 5 | (4) |
| C2 | 3 | (6) |
| C3 | 2 | (7) |

Experimental Example 1 of Layer-Jetting

In experimental example 1, plural layered inks (layered inks of working examples 1-1 and 1-2 and comparative examples 1-1 to 1-4) were manufactured by changing the jetting order of 3 types of aqueous UV inks (C1 to C3) having the same color but different pigment concentrations and layer-jetting the aqueous UV inks onto paper sheets P. From Table 2, the ranks of the magnitudes of the absorption intensities of the pigments in the wavelength of 280 nm are C1>C2>C3, which is equal to the pigment concentration order.

Experimental Example 2 of Layer-Jetting

In experimental example 2, plural layered inks (layered inks of working examples 2-1 and 2-2 and comparative examples 2-1 to 2-4) were manufactured by changing the jetting order of 3 types of aqueous UV inks (M1, K1, and C3) having the same pigment concentrations but different color types and different absorption intensities in the absorption wavelength peak (280 nm) of the photopolymerization initiator and layer-jetting the inks onto paper sheets P. From Table 2, the ranks of the magnitudes of the absorption intensities of the pigments in the wavelength of 280 nm are M1>K1>C3.

Experimental Example 3 of Layer-Jetting

In experimental example 3, plural layered inks (layered inks of working examples 3-1 and 3-2 and comparative examples 3-1 to 3-4) were manufactured by changing the jetting order of 3 types of aqueous UV inks (M2, K2, and C2) having different pigment concentrations and color types and different absorption intensities in the absorption wavelength peak (280 nm) of the photopolymerization initiator and layer-jetting the inks onto paper sheets P. From Table 2, the ranks of the magnitudes of the absorption intensities of the pigments at the wavelength of 280 nm are M2>K2>C2, which is equal to the pigment concentration order.

Experimental Example 4 of Layer-Jetting

In experimental example 4, plural layered inks (layered inks of working examples 4-1 and 4-2 and comparative examples 4-1 to 4-4) were manufactured by changing the jetting order of 3 types of aqueous UV inks (M1, K2, and C1) having different pigment concentrations and color types and different absorption intensities in the absorption wavelength peak (280 nm) of the photopolymerization initiator and layer-jetting the inks onto paper sheets P. From Table 2, the ranks of the magnitudes of the absorption intensities of the pigments at the wavelength of 280 nm are K2>M1>C1, which is different from the pigment concentration order.

(Evaluation of Film Strength)

Film strength was evaluated in regard to the layered inks of the working examples and comparative examples of experimental examples 1 to 4.

The following method was used for the evaluation of film strength.

First, cellophane tape (made by Nichiban Co., Ltd.) cut to about 30 mm was adhered, in such a way as to not trap air, to the image surfaces of the solid images (layered inks) that had been conditioned for one day in a standard environment (23° C. and 50% RH) after the layer-jetting. Then, the cellophane tape was slowly peeled away vertically upward over a period of about 3 seconds. The change in the shape of the surface from which the cellophane tape was peeled off and the transfer of color to the cellophane tape were visually observed, and an evaluation of film strength was made according to the following evaluation method.

"5": No detachment, or detachment within layer of paper

"4": Color transferred a little (within 10% of the tape area) to tape, but no change in ink surface (image surface)

"3": Color transferred to tape, but no change in ink surface

"2": Change in part of ink surface

"1": Change in entire ink surface or detachment between ink layer and paper

An evaluation of "4" or higher is the allowable range of film strength.

Table 3 to Table 6 below show the results of evaluating the film strength in the layered inks of the working examples and the comparative examples of experimental examples 1 to 4.

TABLE 3

| | | Aqueous UV Ink Jetting Order | | | Evaluation Film |
|---|---|---|---|---|---|
| | | First | Second | Third | Strength |
| Working Example | 1-1 | C1 | C2 | C3 | 5 |
| Working Example | 1-2 | C1 | C3 | C2 | 4.5 |
| Comparative Example | 1-1 | C2 | C1 | C3 | 3.5 |
| Comparative Example | 1-2 | C2 | C3 | C1 | 3 |
| Comparative Example | 1-3 | C3 | C1 | C2 | 3 |
| Comparative Example | 1-4 | C3 | C2 | C1 | 2 |

TABLE 4

| | | Aqueous UV Ink Jetting Order | | | Evaluation Film |
|---|---|---|---|---|---|
| | | First | Second | Third | Strength |
| Working Example | 2-1 | M1 | K1 | C3 | 5 |
| Working Example | 2-2 | M1 | C3 | K1 | 4 |
| Comparative Example | 2-1 | K1 | M1 | C3 | 3 |
| Comparative Example | 2-2 | K1 | C3 | M1 | 2 |
| Comparative Example | 2-3 | C3 | M1 | K1 | 3 |
| Comparative Example | 2-4 | C3 | K1 | M1 | 2 |

TABLE 5

| | | Aqueous UV Ink Jetting Order | | | Evaluation Film |
|---|---|---|---|---|---|
| | | First | Second | Third | Strength |
| Working Example | 3-1 | M2 | K2 | C2 | 5 |
| Working Example | 3-2 | M2 | C2 | K2 | 4 |
| Comparative Example | 3-1 | K2 | M2 | C2 | 3 |
| Comparative Example | 3-2 | K2 | C2 | M2 | 1 |
| Comparative Example | 3-3 | C2 | M2 | K2 | 1 |
| Comparative Example | 3-4 | C2 | K2 | M2 | 1 |

TABLE 6

| | | Aqueous UV Ink Jetting Order | | | Evaluation Film |
|---|---|---|---|---|---|
| | | First | Second | Third | Strength |
| Comparative Example | 4-1 | M1 | K2 | C1 | 3 |
| Comparative Example | 4-2 | M1 | C1 | K2 | 1 |
| Working Example | 4-1 | K2 | M1 | C1 | 5 |
| Working Example | 4-2 | K2 | C1 | M1 | 4 |
| Comparative Example | 4-3 | C1 | M1 | K2 | 1 |
| Comparative Example | 4-4 | C1 | K2 | M1 | 2 |

From the results shown in Table 3 to Table 5, it was understood that descending order of pigment concentration and descending order of the ultraviolet absorption intensity of the pigment in the ultraviolet wavelength of 280 nm in which the ultraviolet absorption intensity of the photopolymerization initiator reaches a peak result in descending order of the film strength of the layered inks However, from the results shown in Table 6, it was understood that depending on the combination of the aqueous UV inks, there are also cases where descending order of pigment concentration does not always result in descending order of the ultraviolet absorption intensity of the pigment in the wavelength of 280 nm, and in this case descending order of the ultraviolet absorption intensity of the pigment in the wavelength of 280 nm results in descending order of the film strength of the layered inks.

From the above, the present inventors discovered that the film strength of the layered inks is affected not by the pigment concentration but by the ultraviolet absorption intensity of the pigment in the wavelength of 280 nm and that in all of experimental examples 1 to 4, descending order of the ultraviolet absorption intensity of the pigment in the wavelength of 280 nm results in descending order of the film strength of the layered inks.

Additionally, it was understood that the layered inks of working examples 1-1, 2-1, 3-1, and 4-1, which are descending order of the ultraviolet absorption intensity of the pigment in the wavelength of 280 nm, had a film strength of "5", had the highest evaluations among working examples 1-2, 2-2, 3-2, and 4-2 and comparative examples 1-1 to 4-4, and had film strengths sufficient to withstand actual use. Further, it was understood that in working examples 1-2, 2-2, 3-2, and 4-2 also—in which the aqueous UV ink whose pigment has the largest ultraviolet absorption intensity in the wavelength of 280 nm was jetted first and then the aqueous UV ink having the smallest absorption intensity was jetted second, rather than the remaining aqueous UV inks being jetted in descending order of the ultraviolet absorption intensity of the pigment in the wavelength of 280 nm—the film strengths of the layered inks were "4" and withstand actual use.

What is claimed is:

1. An inkjet recording apparatus comprising:

a plurality of jetting heads that jet respectively different types of photocurable color inks onto a conveyed recording medium and which, when layer-jetting the different types of photocurable color inks onto the recording medium, first jet the photocurable color ink having the largest light blocking effect among the plurality of photocurable color inks that the plurality of jetting heads layer-jet; and an irradiation device that applies light to the photocurable color inks that have been jetted onto the recording medium;

wherein when the plurality of jetting heads layer-jet the photocurable color inks, the plurality of jetting heads jet the photocurable color inks in descending order of light blocking effect; and the plurality of jetting heads are placed from upstream to downstream in a conveyance direction of the recording medium in such a way as to jet the photocurable color inks in descending order of light blocking effect.

2. The inkjet recording apparatus according to claim 1, wherein the different types of photocurable color inks each include a common photopolymerization initiator and different types of pigments, and when the plurality of jetting heads layer-jet the photocurable color inks, the plurality of jetting heads first jet the photocurable color ink whose pigment has the largest light absorption intensity in the light wavelength range in which the light absorption intensity of the photopolymerization initiator reaches a peak.

3. The inkjet recording apparatus according to claim 1, further comprising an adjustment unit that adjusts the peak illuminance value of the irradiation device or the integrated amount of irradiation in accordance with the combination of the photocurable color inks when the photocurable color inks are layer-jetted.

4. The inkjet recording apparatus according to claim 3, wherein the adjustment unit adjusts the peak illuminance value by varying the output of a light source of the irradiation device or adjusts the peak illuminance value by varying the distance between the light source of the irradiation device and the conveyed recording medium.

5. The inkjet recording apparatus according to claim 1, further comprising a drying section that dries the recording medium in such a way that the water content on the recording medium including water in the photocurable color inks becomes 3.0 $g/m^2$ or less before the application of light by the irradiation device.

6. The inkjet recording apparatus according to claim 1, further comprising an aggregating agent application section which, before the photocurable color inks are jetted, applies to the recording medium an aggregating agent that causes the photocurable color inks that are to be jetted to aggregate.

7. The inkjet recording apparatus according to claim 1, wherein the jetting heads jet the photocurable color inks in such a way that the total amount of the photocurable color inks on the recording medium becomes a maximum of 15 $ml/m^2$ or less.

8. An inkjet recording method of layer-jetting different types of photocurable color inks onto a conveyed recording medium, the inkjet recording method comprising:

jetting, using a plurality of jetting heads, first the photocurable color ink having the largest light blocking effect among the plurality of photocurable color inks that the plurality of jetting heads layer-jet and to thereafter jet the remaining photocurable color inks in such a way that the remaining photocurable color inks become layered on the photocurable color ink having the largest light blocking effect; and irradiating, using an irradiation device, light to the photocurable color inks that have been layer-jetted onto the recording medium;

wherein when the plurality of jetting heads layer-jet the photocurable color inks, the plurality of jetting heads jet the photocurable color inks in descending order of light blocking effect; and the plurality of jetting heads are placed from upstream to downstream in a conveyance direction of the recording medium in such a way as to jet the photocurable color inks in descending order of light blocking effect.

* * * * *